US012607371B2

(12) United States Patent
Raman et al.

(10) Patent No.: US 12,607,371 B2
(45) Date of Patent: Apr. 21, 2026

(54) SYSTEMS AND METHODS FOR TUNING RADIATIVE HEAT FLOWS BETWEEN INTERIOR SURFACES AND HUMAN OCCUPANTS

(71) Applicant: The Regents of the University of California, Oakland, CA (US)

(72) Inventors: Aaswath Pattabhi Raman, Los Angeles, CA (US); Jin Xu, Oakland, CA (US)

(73) Assignee: The Regents of the University of California, Oakland, CA (US)

( * ) Notice: Subject to any disclaimer, the term of this patent is extended or adjusted under 35 U.S.C. 154(b) by 255 days.

(21) Appl. No.: 17/756,519

(22) PCT Filed: Nov. 25, 2020

(86) PCT No.: PCT/US2020/062369
§ 371 (c)(1),
(2) Date: May 26, 2022

(87) PCT Pub. No.: WO2021/108668
PCT Pub. Date: Jun. 3, 2021

(65) Prior Publication Data

US 2022/0412582 A1 Dec. 29, 2022

Related U.S. Application Data

(60) Provisional application No. 62/941,593, filed on Nov. 27, 2019.

(51) Int. Cl.
*F24F 5/00* (2006.01)
*F25B 23/00* (2006.01)

(52) U.S. Cl.
CPC ..... *F24F 5/0089* (2013.01); *F25B 23/003* (2013.01)

(58) Field of Classification Search
CPC ..... F24F 5/0089; F24F 5/0092; F25B 23/003; F28F 13/14; F28F 13/16; F28F 13/18; F28F 2245/06; F28F 2255/06
See application file for complete search history.

(56) References Cited

U.S. PATENT DOCUMENTS 3,374,830 A * 3/1968 O'Sullivan, Jr. ..... B64G 1/50 165/96
3,496,011 A 2/1970 Crosby et al.
(Continued)

FOREIGN PATENT DOCUMENTS

CN 102352160 A 2/2012
CN 103137732 A 6/2013
(Continued)

OTHER PUBLICATIONS

Extended European Search Report for European Application No. 21761496.5, Search completed Jan. 24, 2024, Mailed Feb. 2, 2024, 9 pgs.
(Continued)

*Primary Examiner* — Travis Ruby
(74) *Attorney, Agent, or Firm* — KPPB LLP

(57) ABSTRACT

A device for controlling radiative heat flow between interior surfaces and human occupants includes a tunable emissivity material disposed between electrodes is provided. The tunable emissivity material has a low emissivity state with emissivity smaller than about 0.5 over wavelength range from about 7 microns to about 14 microns for reflecting heat, and a high emissivity state with emissivity larger than about 0.8 over the same wavelength range for absorbing heat. A voltage is applied to tune the emissivity material between states to regulate radiative heat flow and maintain thermal comfort. The tunable emissivity material may be a conducting polymer, inorganic oxide such as tungsten trioxide or
(Continued)

vanadium dioxide, or lithium titanate. The device can be applied to walls, floors, ceilings, or windows.

15 Claims, 12 Drawing Sheets

(56) References Cited

U.S. PATENT DOCUMENTS 3,708,220 A * 1/1973 Meyers ..... G02F 1/1525 429/111
4,082,414 A 4/1978 Berg
4,461,532 A * 7/1984 Sato ..... G02B 5/282 359/359
4,489,906 A * 12/1984 Fellas ..... B32B 7/12 427/525
4,569,088 A 2/1986 Frankenburg et al.
4,586,350 A * 5/1986 Berdahl ..... F25B 23/003 359/360
4,618,218 A * 10/1986 Shaw ..... G02B 26/02 359/360
5,071,702 A 12/1991 Matsuura et al.
5,242,632 A 9/1993 Mende
5,403,405 A 4/1995 Fraas et al.
5,564,568 A 10/1996 Rankin, Sr.
5,638,205 A * 6/1997 Meisel ..... B64G 1/50 359/360
5,774,255 A * 6/1998 Howard ..... F24S 50/80 359/267
6,084,702 A 7/2000 Byker et al.
6,337,129 B1 1/2002 Watanabe et al.
6,461,729 B1 10/2002 Dugan
6,899,170 B2 * 5/2005 Biter ..... B64G 1/503 165/277
7,135,035 B1 11/2006 Dimmick
7,691,284 B2 4/2010 Cumberland et al.
7,973,696 B2 7/2011 Puscasu et al.
8,610,992 B2 12/2013 Varaprasad et al.
8,619,363 B1 12/2013 Coleman
8,679,582 B2 * 3/2014 Cumberland ..... B64G 1/54 427/226
9,207,515 B2 * 12/2015 Chandrasekhar ..... G02F 1/155
9,394,623 B2 7/2016 Grimes et al.
10,073,191 B2 9/2018 Shen et al.
10,094,139 B2 10/2018 Hotes et al.
10,228,197 B2 * 3/2019 Cognata ..... F28F 13/00
10,323,151 B2 6/2019 Van Overmeere et al.
2006/0132905 A1 6/2006 Wu et al.
2007/0175874 A1 8/2007 Beeson et al.
2008/0196304 A1 8/2008 Pope
2008/0305338 A1 12/2008 Mizutani et al.
2009/0255917 A1 10/2009 Feichko et al.
2009/0311930 A1 12/2009 Wang et al.
2010/0136213 A1 6/2010 Hossainy et al.
2010/0189993 A1 7/2010 Mori et al.
2012/0095145 A1 4/2012 Zhou et al.
2012/0183720 A1 7/2012 Wang
2012/0225600 A1 9/2012 Rule et al.
2013/0061739 A1 3/2013 Cheong et al.
2014/0147398 A1 5/2014 Hamilton et al.
2015/0338175 A1 * 11/2015 Raman ..... B60H 1/32 165/185
2016/0057830 A1 2/2016 Klett et al.
2016/0362807 A1 * 12/2016 Casse ..... F28F 13/185
2017/0248381 A1 8/2017 Yang et al.
2017/0328654 A1 * 11/2017 Cognata ..... F28F 13/14
2017/0335128 A1 11/2017 Xue et al.
2018/0180331 A1 6/2018 Yu et al.
2018/0244928 A1 8/2018 Van Overmeere et al.
2019/0056184 A1 2/2019 Han et al.
2019/0086164 A1 3/2019 Yang et al.
2019/0106613 A1 * 4/2019 Wang ..... F28F 21/06
2019/0174683 A1 * 6/2019 Divigalpitiya ..... E06B 9/264
2019/0178720 A1 6/2019 Padilla et al.
2019/0333490 A1 * 10/2019 Wang ..... B32B 9/045
2020/0008316 A1 * 1/2020 Cola ..... H01L 23/373
2020/0292214 A1 * 9/2020 Bergman ..... F25B 21/04
2020/0355448 A1 * 11/2020 Lenert ..... H02S 40/425
2020/0393148 A1 * 12/2020 Teitelbaum ..... F24D 3/14
2021/0002491 A1 * 1/2021 Xu ..... C09D 167/00
2021/0018713 A1 1/2021 Hebrink et al.
2021/0024143 A1 1/2021 Li et al.
2021/0063612 A1 * 3/2021 Gorodetsky ..... B32B 5/02
2021/0251360 A1 8/2021 Ahrens
2021/0254869 A1 8/2021 Gan et al.
2021/0332281 A1 10/2021 Takahashi et al.
2022/0289938 A1 9/2022 Fernández et al.
2022/0381524 A1 12/2022 Mandal et al.
2023/0067651 A1 3/2023 Mandal et al.

FOREIGN PATENT DOCUMENTS

CN 110103559 A 8/2019
EP 4110612 A1 1/2023
GB 2339785 A 2/2000
WO 2000007411 A1 2/2000
WO 2015198762 A1 12/2015
WO 2016205717 A1 12/2016
WO 2019130199 A1 7/2019
WO 2019179974 A1 9/2019
WO 2020072818 A1 4/2020
WO 2021087128 A1 5/2021
WO 2021108668 A1 6/2021
WO 2021173696 A1 9/2021

OTHER PUBLICATIONS

International Preliminary Report on Patentability for International Application PCT/US2021/019448, Report issued Aug. 30, 2022, Mailed on Sep. 9, 2022, 11 pgs.
International Preliminary Report on Patentability for International Application PCT/US2020/057986, Report issued May 3, 2022, Mailed May 12, 2022, 20 pgs.
International Preliminary Report on Patentability for International Application PCT/US2020/062369, Report issued May 17, 2022, Mailed on Jun. 9, 2022, 9 pgs.
International Search Report and Written Opinion for International Application No. PCT/US2020/062369, Search completed Jan. 19, 2021, Mailed Feb. 23, 2021, 21 pgs.
International Search Report and Written Opinion for International Application No. PCT/US2020/057986, Search completed Dec. 21, 2020, Mailed Jan. 7, 2021, 26 pgs.
International Search Report and Written Opinion for International Application No. PCT/US2021/019448, Search completed Apr. 21, 2021, Mailed May 6, 2021, 15 pgs.
"Commercial reference buildings", Retrieved from "<www.energy.gov/eere/buidings/commercial-reference-buildings>" on May 10, 2024, 2 pgs.
"The heat is on", Nature Energy, Dec. 6, 2016, vol. 1, No. 12, Article 16193, 1 pg., doi: 10.1038/nenergy.2016.193.
Akr et al., "Thermophotovoltaics with spectral and angular selective doped-oxide thermal emitters", Optics Express, vol. 25, No. 20, Oct. 2, 2017, pp. A880-A895.
ANSI/ASHRAE, "Thermal Environmental Conditions for Human Occupancy", ANSI/ASHRAE Standard 55—2004, 34 pgs.
Arslanoglu et al., "Experimental and theoretical investigation of the effect of radiation heat flux on human thermal comfort", Energy and Buildings, vol. 113, Feb. 1, 2016, pp. 23-29, doi: 10.1016/j.enbuild.2015.12.039.
Badsha et al., "Admittance matching analysis of perfect absorption in unpatterned thin films", Optics Communications, vol. 332, Dec. 1, 2014, pp. 206-213, doi: 10.1016/j.optcom.2014.07.004.
Baniassadi et al., "Potential energy and climate benefits of super-cool materials as a rooftop strategy", Urban Climate, vol. 29, No. 100495, Sep. 2019, 36 pgs., doi: 10.1016/j.uclim.2019.100495.
Beenakker, "Thermal Radiation and Amplified Spontaneous Emission from a Random Medium", Physical Review Letters, vol. 81, No. 9, Aug. 31, 1998, pp. 1829-1832, doi: 10.1103/PhysRevLett.81.1829.

(56) References Cited

OTHER PUBLICATIONS

Brooke et al., "Infrared Electrochromic Conducting Polymer Devices", Journals of Materials Chemistry C, vol. 5, No. 23, May 30, 2017, pp. 5824-5830, doi: 10.1039/c7tc00257b.
Cai et al., "Temperature Regulation in Colored Infrared-Transparent Polyethylene Textiles", Joule, vol. 3, No. 6, Jun. 19, 2019, pp. 1478-1486, doi: 10.1016/j.joule.2019.03.015.
Cai et al., "Warming up human body by nanoporous metallized polyethylene textile", Nature Communications, vol. 8, No. 496, Sep. 19, 2017, pp. 1-8, doi: 10.1038/s41467-017-00614-4.
Cheng et al., "Experimental and numerical investigations on stratified air distribution systems with special configuration: Thermal comfort and energy saving", Energy and Buildings, vol. 64, Sep. 2013, pp. 154-161, doi: 10.1016/j.enbuild.2013.04.026.
Coppens et al., "Spatial and Temporal Modulation of Thermal Emission", Advanced Materials, vol. 29, No. 1701275, Aug. 21, 2017, 6 pgs., doi: 10.1002/ADMA.201701275.
Costantini et al., "Plasmonic Metasurface for Directional and Frequency-Selective Thermal Emission", Physical Review Applied, vol. 4, No. 1, 2015, pp. 014023-1-014023-6, doi: 10.1103/PhysRevApplied.4.014023.
Coutts et al., "Temperature and human thermal comfort effects of street trees across three contrasting street canyon environments", Theoretical Applies Climatology, vol. 124, No. 1-2, 2016, pp. 55-68, published online Feb. 17, 2015, doi: 10.1007/s00704-015-1409-y.
Dang et al., "A Designed Broadband Absorber Based on ENZ Mode Incorporating Plasmonic Metasurfaces", Micromachines, vol. 10, No. 673, Oct. 4, 2019, pp. 1-11, doi: 10.3390/mi10100673.
Fumo et al., "Methodology to estimate building energy consumption using EnergyPlus Benchmark Models", Energy and Buildings, vol. 42, No. 12, Dec. 2010, pp. 2331-2337, doi: 10.1016/j.enbuild.2010.07.027.
Gentle et al., "Radiative Heat Pumping from the Earth Using Surface Phonon Resonant Nanoparticles", Nano Letters, vol. 10, No. 2, Jan. 7, 2010, pp. 373-379, doi: 10.1021/nl903271d.
Greffet et al., "Coherent spontaneous emission of light by thermal sources", Nature, vol. 416, No. 6876, Mar. 7, 2002, pp. 61-64, doi: 10.1038/416061a.
Guo et al., "Fluoroalkylsilane-Modified Textile-Based Personal Energy Management Device for Multifunctional Wearable Application", ACS Applied Material Interfaces, vol. 8, No. 7, Jan. 26, 2016, pp. 4676-4683, doi: 10.1021/acsami.5b11622.
Guo et al., "Tunable broadband, wide angle and lithography-free absorber in the near-infrared using an ultrathin VO2 film", Applied Physics Express, vol. 12, No. 7, Jun. 26, 2019, pp. 071005-1-071005-6, doi: 10.7567/1882-0786/ab29e4.
Hensen, "Literature review on thermal comfort in transient conditions", Building and Environment, vol. 25, No. 4, 1990, pp. 309-316, doi: 10.1016/0360-1323(90)90004-B.
Hossain et al., "Radiative Cooling: Principles, Progress, and Potentials", Advanced Science, vol. 3, No. 1500360, 2016, 10 pgs., doi: 10.1002/advs.201500360.
Hoyt et al., "Energy savings from extended air temperature setpoints and reductions in room air mixing", International Conference of Environmental Ergonomics Aug. 2-7, 2005, published Aug. 2, 2005, pp. 608-612.
Hsu et al., "Personal Thermal Management by Metallic Nanowire-Coated Textile", Nano Letters, vol. 15, No. 1, 2015, pp. 365-371, first published Nov. 30, 2014, doi: 10.1021/nl5036572.
Hsu et al., "Radiative human body cooling by nanoporous polyethylene textile", Science, vol. 353, No. 6303, Sep. 2, 2016, pp. 1019-1023, doi: 10.1126/science.aaf5471.
Hulley et al., "High spatial resolution imaging of methane and other trace gases with the airborne Hyperspectral Thermal Emission spectrometer (HyTES)", Atmospheric Measurement Techniques, vol. 9, Jun. 1, 2016, pp. 2393-2408, doi: 10.5194/amt-9-2393-2016.
Inoue et al., "Realization of dynamic thermal emission control", Nature Materials, vol. 13, No. 10, Oct. 2014, pp. 928-931, early publish Jul. 27, 2014, doi: 10.1038/nmat4043.
Joudi et al., "Highly reflective coatings for interior and exterior steel cladding and the energy efficiency of buildings", Applied Energy, vol. 88, No. 12, Dec. 2011, pp. 4655-4666, doi: 10.1016/j.apenergy.2011.06.002.
Jung et al., "Next-generation mid-infrared sources", Journal of Optics, vol. 19, No. 12, Nov. 14, 2017, 31 pgs., doi: 10.1088/2040-8986/aa939b.
Kant et al., "Advances in simulation studies for developing energy-efficient buildings.", Sustainability through energy-efficient Buildings, 2018, pp. 209-233, doi: 10.1201/9781315159065-11.
Kingma et al., "Energy consumption in buildings and female thermal demand", Nature Climate Change, vol. 5, No. 12, 2015, pp. 1-5, published online Aug. 3, 2015, doi: 10.1038/NCLIMATE2741.
Krayer et al., "Optoelectronic Devices on Index-near-Zero Substrates", ACS Photonics, vol. 6, No. 9, Jul. 15, 2019, pp. 2238-2244, doi: 10.1021/acsphotonics.9b00449.
Laroche et al., "Highly directional radiation generated by a tungsten thermal source", Optics Letters, vol. 30, No. 19, Oct. 1, 2005, pp. 2623-2625, doi: 10.1364/ol.30.002623.
Li et al., "Full Daytime Sub-ambient Radiative Cooling in Commercial-like Paints with High Figure of Merit", Cell Reports Physical Science, vol. 1, No. 100221, Oct. 21, 2020, pp. 1-17, doi: 10.1016/j.xcrp.2020.100221.
Li et al., "Remarkable Daytime Sub-ambient Radiative Cooling in BaSO4 Nanoparticle Films and Paint", Nanoscale radiation and photonics, Nov. 2020, 23 pgs.
Liu et al., "A study of human skin and surface temperatures in stable and unstable thermal environments", Journal of Thermal Biology, vol. 38, No. 7, Oct. 2013, pp. 440-448, doi: 10.1016/j.jtherbio.2013.06.006.
Liu et al., "Evaluation of calculation methods of mean skin temperature for use in thermal comfort study", Building and Environment, vol. 46, No. 2, Feb. 2011, pp. 478-488, doi: 10.1016/j.buildenv.2010.08.011.
Lucchi, "Applications of the infrared thermography in the energy audit of buildings: A review", Renewable and Sustainable Energy Reviews, vol. 82, Part 3, Feb. 2018, pp. 3077-3090, doi: 10.1016/j.rser.2017.10.031.
Luo et al., "Thermal Radiation from Photonic Crystals: A Direct Calculation", Physical Review Letters, vol. 93, No. 21, Nov. 19, 2004, pp. 213905-1-213905-4, doi: 10.1103/PhysRevLett.93.213905.
Mandal et al., "Hierarchically porous polymer coatings for highly efficient passive daytime radiative cooling", Science, vol. 362, No. 6412, Oct. 19, 2018, pp. 315-319, doi: 10.1126/science.aat9513.
Marino et al., "Thermal comfort in indoor environment: Effect of the solar radiation on the radiant temperature asymmetry", Solar Energy, vol. 144, Mar. 1, 2017, pp. 295-309, doi: 10.1016/j.solener.2017.01.014.
Mason et al., "Strong absorption and selective thermal emission from a midinfrared metamaterial", Applied Physics Letters, vol. 98, No. 24, Jun. 13, 2011, pp. 241105-1-241105-3, doi: 10.1063/1.3600779.
Moon et al., "Thermal comfort analysis in a passenger compartment considering the solar radiation effect", International Journal of Thermal Sciences, vol. 107, Sep. 2016, pp. 77-88, doi: 10.1016/j.ijthermalsci.2016.03.013.
Mulford et al., "Control of Net Radiative Heat Transfer With a Variable-Emissivity Accordion Tessellation", Journal of Heat Transfer, vol. 141, No. 3, 032702, Mar. 2019, pp. 032702-1-032702-10, Paper No. HT-18-1519, published online Jan. 30, 2019, doi: 10.1115/1.4042442.
Newman et al., "Ferrell-Berreman Modes in Plasmonic Epsilon-near-Zero Media", ACS Photonics, vol. 2, No. 1, 2015, pp. 2-7, published Dec. 8, 2014, printed from arXiv:1505.06180, May 22, 2015, doi: 10.1021/ph5003297.
Ogulata, "The Effect of Thermal Insulation of Clothing on Human Thermal Comfort", Fibres and Textiles in Eastern Europe, vol. 15, No. 2, Article 61, 2007, pp. 67-72.
Okamoto et al., "Physiological activity in calm thermal indoor environments", Scientific Reports, vol. 7, No. 11519, pp. 1-12, published online Sep. 14, 2017, doi: 10.1038/s41598-017-11755-3.

(56) References Cited

OTHER PUBLICATIONS

Palchetti et al., "Remote sensing of cirrus cloud microphysical properties using spectral measurements over the full range of their thermal emission", Journal of Geophysical Research: Atmospheres, vol. 121, Sep. 23, 2016, pp. 10804-10819, doi: 10.1002/2016JDo25162.
Pan et al., "Sensing Properties of a Novel Temperature Sensor Based on Field Assisted Thermal Emission", Sensors, vol. 17, No. 3, Article 473, Feb. 27, 2017, 7 pgs., doi: 10.3390/s17030473.
Perez-Lombard et al., "A review on buildings energy consumption information", ScienceDirect, Energy and Buildings, vol. 40, No. 3, 2008, pp. 394-398, doi: 10.1016/j.enbuild.2007.03.007.
Qiu et al., "Highly flexible, breathable, tailorable and washable power generation fabrics for wearable electronics", Nano Energy, vol. 58, Apr. 2019, pp. 750-758, doi: 10.1016/j.nanoen.2019.02.010.
Qu et al., "Polarization-Independent Optical Broadband Angular Selectivity", ACS Photonics, vol. 5, No. 10, Aug. 31, 2018, pp. 4125-4131, doi: 10.1021/acsphotonics.8b00862.
Raman et al., "Generating Light from Darkness", Joule, vol. 3, No. 11, Nov. 20, 2019, pp. 2679-2686, doi: 10.1016/j.joule.2019.08.009.
Raman et al., "Passive radiative cooling below ambient air temperature under direct sunlight", Nature, vol. 515, No. 7528, Nov. 27, 2014, pp. 540-544, doi: 10.1038/nature13883.
Rensberg et al., "Epsilon-Near-Zero Substrate Engineering for Ultrathin-Film Perfect Absorbers", Physical Review Applied, vol. 8, No. 014009, Jul. 12, 2017, pp. 014009-1-014009-11, doi: 10.1103/PhysRevApplied.8.014009.
Robinson, "A thermal model for energy loss through walls behind radiators", Energy and Buildings, vol. 127, Sep. 1, 2016, pp. 370-381, doi: 10.1016/j.enbuild.2016.05.086.
Rupp et al., "A review of human thermal comfort in the built environment", Energy and Buildings, vol. 105, Oct. 15, 2015, pp. 178-205, doi: 10.1016/j.enbuild.2015.07.047.
Sakakibara et al., "Practical emitters for thermophotovoltaics: a review", Journal of Photonics for Energy, vol. 9, No. 3, 32713, Feb. 26, 2019, 21 pgs., doi: 10.1117/1.JPE.9.032713.
Shaykhutdinov et al., "Mid-infrared nanospectroscopy of Berreman mode and epsilon-near-zero local field confinement in thin films", Optical Materials Express, vol. 7, No. 10, Oct. 2017, pp. 3706-3714, published Sep. 19, 2017, doi: 10.1364/OME.7.003706.
Shen et al., "Broadband angular selectivity of light at the nanoscale: Progress, applications, and outlook", Applied Physics Reviews, vol. 3, No. 1, 2016, pp. 011103-1-011103-13, doi: 10.1063/1.4941257.
Shen et al., "Building heating and cooling load under different neighbourhood forms: Assessing the effect of external convective heat transfer", Energy, vol. 173, Apr. 15, 2019, pp. 75-91, doi: 10.1016/j.energy.2019.02.062.
Shen et al., "Optical Broadband Angular Selectivity", Science, vol. 343, No. 6178, Mar. 28, 2014, pp. 1499-1501, doi: 10.1126/science.1249799.
Streyer et al., "Engineering absorption and blackbody radiation in the far-infrared with surface phonon polaritons on gallium phosphide", Applied Physics Letters, vol. 104, No. 13, 2014, pp. 131105-1-131105-5, doi: 10.1063/1.4870255.
Sun et al., "Radiative sky cooling: fundamental physics, materials, structures, and applications", Nanophotonics, vol. 6, No. 5, 2017, pp. 997-1015, published online Jul. 27, 2017, doi: 10.1515/nanoph-2017-0020.
Takada et al., "Fundamental study of ventilation in air layer in clothing considering real shape of the human body based on CFD analysis", Building and Environment, vol. 99, Apr. 2016, pp. 210-220, doi: 10.1016/j.buildenv.2016.01.028.
Tao et al., "Broadband and Gate-Tunable Conducting Oxide Epsilon-Near-Zero Perfect Absorber", Frontiers in Optics, Jan. 2018, 2 pgs., doi: 10.1364/FIO.2018.JTu2A.90.
Tao et al., "Broadband Epsilon-Near-Zero Conducting Oxide Absorbers Fabricated by Atomic Layer Deposition", Conference on Lasers and Electro-Optics (CLEO), IEEE 2018, pp. 1-2, doi: 10.1364/CLEO_QELS.2018.FM4J.2.
Tong et al., "Infrared-Transparent Visible-Opaque Fabrics for Wearable Personal Thermal Management", ACS Photonics, vol. 2, No. 6, May 29, 2015, pp. 769-778, doi: 10.1021/acsphotonics.5b00140.
Toudert et al., "Mid-to-far infrared tunable perfect absorption by a sub-λ/100 nanofilm in a fractal phasor resonant cavity", Optics Express, vol. 26, No. 26, Dec. 24, 2018, pp. 34043-34059, doi: 10.1364.OE.26.034043.
Urge-Vorsatz et al., "Heating and cooling energy trends and drivers in buildings", Renewable and Sustainable Energy Reviews, vol. 41, Jan. 2015, pp. 85-98, available online Sep. 6, 2014, doi: 10.1016/j.rser.2014.08.039.
Wang et al., "Electrically switchable highly efficient epsilon-near-zero metasurfaces absorber with broadband response", Results in Physics, Sep. 2019, vol. 14, No. 102376, 7 pgs., available online May 25, 2019, doi: 10.1016/jrinp.2019.102376.
Winslow et al., "The Influence of Air Movement Upon Heat Losses from the Clothed Human Body", American Journal of Physiology-Legacy Content, vol. 127, No. 3, Sep. 30, 1939, pp. 505-518, doi: 10.1152/ajplegacy.1939.127.3.505.
Yang et al., "Thermal comfort and building energy consumption implications—A review", Applied Energy, vol. 115, Feb. 15, 2014, pp. 164-173, available online Nov. 27, 2013, doi: 10.1016/j.apenergy.2013.10.062.
Yoon et al., "Broadband Epsilon-Near-Zero Perfect Absorption in the Near-Infrared", Scientific Reports, vol. 5, No. 12788, Aug. 4, 2015, pp. 1-8, doi: 10.1038/srep12788.
Yu et al., "A review of the development of airflow models used in building load calculation and energy simulation", Building Simulation, vol. 12, No. 2, Feb. 22, 2019, pp. 347-363, doi: 10.1007/S12273-018-0494-0.
Yue et al., "Ag nanoparticles coated cellulose membrane with high infrared reflection, breathability and antibacterial property for human thermal insulation", Journal of Colloid and Interface Science, vol. 535, Feb. 1, 2019, pp. 363-370, doi: 10.1016/j.jcis.2018.10.009.
Zeyghami et al., "A review of clear sky radiative cooling developments and applications in renewable power systems and passive building cooling", Solar Energy Materials and Solar Cells, vol. 178, May 2018, pp. 115-128, doi: 10.1016/j.solmat.2018.01.015.
Zhai et al., "Scalable-manufactured randomized glass-polymer hybrid metamaterial for daytime radiative cooling", Science, vol. 355, No. 6329, Mar. 10, 2017, pp. 1062-1066, doi: 10.1126/science.aai7899.
Zhang et al., "Further Understanding of the Mechanisms of Electrochromic Devices with Variable Infrared Emissivity Based on Polyaniline Conducting Polymers", Journal of Materials Chemistry C, vol. 7, No. 1, Jul. 12, 2019, pp. 9878-9891, doi: 10.1039/c9tc02126d.
Zhang et al., "Preparation and performances of all-solid-state variable infrared emittance devices based on amorphous and crystalline WO3 electrochromic thin films", Solar Energy Materials and Solar Cells, vol. 200, No. 109916, Sep. 15, 2019, 6 pgs., doi: 10.1016/j.solmat.2019.109916.
Zhang et al., "Solution-processable three-dimensional honeycomb-like poly(3,4-ethylenedioxythiophene) nanostructure networks with very fast response speed for patterned electrochromic devices", Solar Energy Materials and Solar Cells, vol. 207, 110354, Apr. 2007, 7 pgs., doi: 10.1016/j.solmat.2019.110354.
Zhou et al., "Fabrication of Flexible and Superhydrophobic Melamine Sponge with Aligned Copper Nanoparticle Coating for Self-Cleaning and Dual Thermal Management", Industrial & Engineering Chemistry Research, vol. 58, No. 12, Mar. 4, 2019, pp. 4844-4852, doi: 10.1021/acs.iecr.9b00041.
Gong et al., "Novel Mid-Infrared Metamaterial Thermal Emitters for Optical Gas Sensing", Frontiers in Optics / Laser Science, OSA Technical Digest (Optical Society of America, 2018), paper JTu3A.89.
Gieseler et al., "Apparent Emissivity Measurement of Semi-Transparent Materials Part 1: Experimental Realization", Journal of Quantitative Spectroscopy & Radiative Transfer, Sep. 2020, vol. 257, pp. 1-12.
Qi et al., "Effect of Titanium Dioxide (TiO2) with Different Crystal Forms and Surface Modifications on Cooling Property and Surface

(56) References Cited

OTHER PUBLICATIONS

Wettability of Cool Roofing Materials", Solar Energy Materials and Solar Cells, Jun. 2017, 172, pp. 34-43.

* cited by examiner

SYSTEMS AND METHODS FOR TUNING RADIATIVE HEAT FLOWS BETWEEN INTERIOR SURFACES AND HUMAN OCCUPANTS

CROSS-REFERENCE TO RELATED APPLICATIONS

The application is a national stage of PCT Application No. PCT/US20/62369, entitled "SYSTEMS AND METHODS FOR TUNING RADIATIVE HEAT FLOWS BETWEEN INTERIOR SURFACES AND HUMAN OCCUPANTS" to Raman et al., filed Nov. 25, 2020, which claims priority to U.S. Provisional Patent Application No. 62/941,593, entitled "METHODS AND SYSTEMS FOR TUNING RADIATIVE HEAT FLOWS BETWEEN INTERIOR SURFACES AND HUMAN OCCUPANTS" to Raman et al., filed on Nov. 27, 2019, the disclosures of which are included herein by reference in their entirety.

FIELD OF THE INVENTION

The present invention generally relates to methods for tuning radiative heat flows between interior surfaces and human occupants; and more particularly to improved heating and cooling efficiency by incorporating tunable emissivity materials.

BACKGROUND OF THE INVENTION

Energy consumption in residential and commercial buildings contributes to 30% of total greenhouse gas emissions worldwide. In the United States, the buildings sector accounts for 41% of primary energy consumption, of which heating and cooling alone is responsible for over 35%. Heating can pose a profound challenge for broader decarbonisation goals in temperate and cool climates. With energy consumption for heating and cooling expected to grow dramatically worldwide, improving the efficiency of these systems may be an important part of mitigating climate change.

BRIEF SUMMARY OF THE INVENTION

Methods and systems for tuning radiative heat flows between interior surfaces and human occupants are illustrated.

One embodiment of the invention includes a surface for controlling heat flow between an interior space and at least one human occupant comprising at least one tunable emissivity material; at least one power source; at least two electrodes, where the tunable emissivity material is placed in between the at least two electrodes, where the tunable emissivity material has a low emissivity state and the material reflects heat from the interior surface and the human occupant; where the tunable emissivity material has a high emissivity state and the material absorbs heat from the interior surface and the human occupant; and the tunable emissivity ranges from 0.1 to 0.9 in long-wave infrared wavelength.

In a further embodiment, the surface is a wall, a floor, or a ceiling.

In another embodiment, the tunable emissivity material is a conducting polymer, an inorganic oxide, or a thermochromic material.

In a still further embodiment, the conducting polymer is poly(3,4-ethylenedioxythiophene), poly(3,4-ethylenedioxythiophene) tosylate, poly(3,4-ethylenedioxythiophene) polystyrene sulfonate, or polyaniline.

In still another embodiment, the surface further comprising a solid electrolyte layer between the conducting polymer and an electrode.

In yet another embodiment, the inorganic oxide is tungsten trioxide, hydrogen tungsten bronzes or vanadium dioxide.

In a yet further embodiment, the inorganic oxide is ion-irradiated vanadium dioxide.

In another embodiment, the tunable emissivity material comprises lithium titanate.

In a further embodiment, tuning the surface to the low emissivity state decreases a set point temperature of the interior space in cold weather.

In yet another embodiment, the decrease in the set point temperature of the interior space in cold weather results in energy saving.

In another additional embodiment, tuning the surface to the high emissivity state increases a set point temperature of the interior space in warm weather.

In a yet further embodiment, the increase in the set point temperature of the interior space in warm weather results in energy saving.

In yet another embodiment, the tunable emissivity material is transparent over visible wavelength.

In a still further embodiment, the surface is a window.

Still another additional embodiment includes a surface for controlling heat flow between an interior space and at least one human occupant comprising at least two sides, where at least a first side has a low emissivity in the long-wave infrared wavelength, and at least a second side has a high emissivity in the long-wave infrared wavelength, and the at least two sides are rotatable mechanically.

In another embodiment, rotating to the low emissivity side decreases a set point temperature of the interior space in cold weather.

In still another embodiment, the decrease in the set point temperature of the interior space in cold weather results in energy saving.

In a yet further embodiment, rotating to the high emissivity side increases a set point temperature of the interior space in warm weather.

In a still further embodiment, the increase in the set point temperature of the interior space in warm weather results in energy saving.

In yet another embodiment, the at least two sides are transparent over visible wavelength.

In another additional embodiment, the surface is a window.

Another further embodiment again includes a method for tuning radiative heat flow between at least one interior surface and at least one human occupant comprising providing at least one interior surface comprising at least one tunable emissivity material; applying a voltage to the tunable emissivity material; and tuning the emissivity of the interior surface to regulate the radiative heat flow depending on surrounding temperature; where the tunable emissivity material has a low emissivity state wherein the material reflects heat from the interior surface and the human occupant, and the tunable emissivity material has a high emissivity state where the material absorbs heat from the interior surface and the human occupant; and the tunable emissivity of the material ranges from 0.1 to 0.9 in long-wave infrared wavelength.

In an additional embodiment, the at least one interior surface is a wall, a floor, or a ceiling.

In a still further embodiment, the tunable emissivity material is a conducting polymer, an inorganic oxide, or a thermochromic material.

In yet another embodiment, the conducting polymer is poly(3,4-ethylenedioxythiophene), poly(3,4-ethylenedioxythiophene) tosylate, poly(3,4-ethylenedioxythiophene) polystyrene sulfonate, or polyaniline.

In another embodiment, the inorganic oxide is tungsten trioxide, hydrogen tungsten bronzes or vanadium dioxide.

In still yet another embodiment, the inorganic oxide is ion-irradiated vanadium dioxide.

In a further embodiment again, the tunable emissivity material comprises lithium titanate.

In still another embodiment, tuning the surface to the low emissivity state decreases a set point temperature of the interior space in cold weather.

In a further additional embodiment, the decrease in the set point temperature of the interior space in cold weather results in energy saving.

In a still further embodiment, tuning the surface to the high emissivity state increases a set point temperature of the interior space in warm weather.

In yet another embodiment, the increase in the set point temperature of the interior space in warm weather results in energy saving.

Additional embodiments and features are set forth in part in the description that follows, and in part will become apparent to those skilled in the art upon examination of the specification or may be learned by the practice of the disclosure. A further understanding of the nature and advantages of the present disclosure may be realized by reference to the remaining portions of the specification and the drawings, which forms a part of this disclosure

BRIEF DESCRIPTION OF THE DRAWINGS

The description will be more fully understood with reference to the following figures, which are presented as exemplary embodiments of the invention and should not be construed as a complete recitation of the scope of the invention, wherein.

DETAILED DESCRIPTION OF THE INVENTION

Figure 1B:
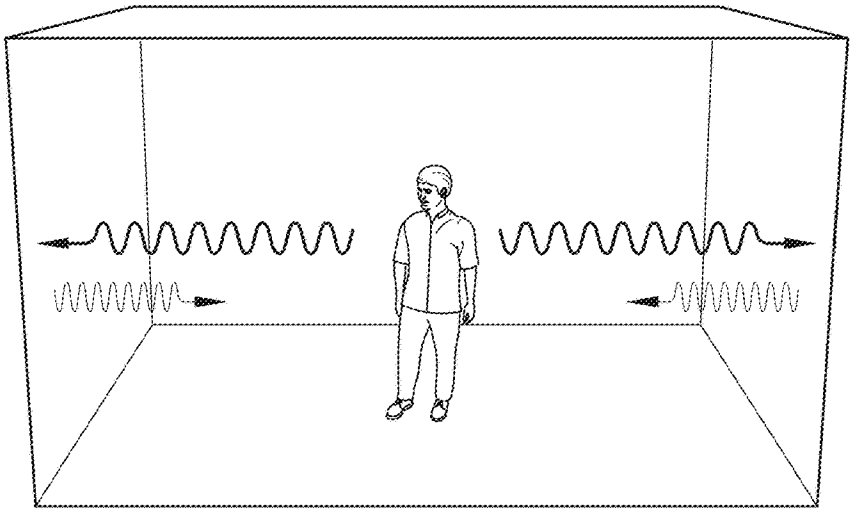
FIGS. 1*a* and 1*b* conceptually illustrate the tunable emissivity surfaces and human occupants, where FIG. 1*a* conceptually illustrates low-emissivity, high-reflectivity interiors reflect radiative heat back to the body in cold weather conditions, and FIG. 1*b* conceptually illustrates high-emissivity interior surfaces absorb the radiative heat released from the occupant inside during warm-weather conditions in accordance with embodiments.

Turning now to the drawings, methods and systems for tuning radiative heat flows between interior surfaces and human occupants are described. Many embodiments implement tunability of interior surfaces for maximal year-round energy efficiency. In many embodiments, the tuning can be accomplished by dynamically tuning the thermal emissivity of interior building surfaces at long-wave infrared (LWIR) wavelengths to maintain thermal comfort. A number of embodiments implement materials that have tunable emissivity in the LWIR spectrum. Some embodiments implement materials with electrochromic properties to tune emissivity over LWIR wavelengths. Examples of tunable emissivity materials include (but are not limited to): conducting polymers, inorganic oxides, and lithium titanate. Examples of conducting polymers with tunable emissivity in the LWIR spectrum include (but are not limited to): poly(3,4-ethylenedioxythiophene) tosylate (PEDOT), poly(3,4-ethylenedioxythiophene) tosylate (PEDOT:Tos), poly(3,4-ethylenedioxythiophene) polystyrene sulfonate (PEDOT:PSS) and polyaniline. In some embodiments, the doping concentration of conducting polymers can affect emissivity in LWIR wavelengths. Several embodiments show that doped conducting polymer can have a relatively low emissivity in LWIR ranges while undoped conducting polymer may have a relatively high emissivity. Examples of inorganic oxides with tunable emissivity in the LWIR spectrum include (but are not limited to): tungsten trioxide ($WO_3$), hydrogen tungsten bronzes ($H_xWO_3$), and vanadium dioxide. Some embodiments implement ion-irradiated vanadium dioxide for tuning emissivity in interior spaces. In many embodiments, emissivity of the tunable materials in LWIR wavelengths can be tuned electrically including (but not limited to) by applying a voltage. Applied voltage may change the doping concentrations of conducting polymer and hence tune the emissivity in accordance with some embodiments. In several embodiments, tunable emissivity materials can be incorporated in mechanical devices. Emissivity in LWIR ranges can be tuned mechanically in accordance with certain embodiments. In a number of embodiments, low emissivity and high emissivity materials can be applied to different sides of mechanical blinds, and different sides can be switched in response to the weather.

Several embodiments implement that in cold weather conditions, tuning the emissivity of interior surfaces including (but not limited to) walls, floors, windows, and ceilings to a low value can decrease set point temperatures of heating systems. In many embodiments, tunable emissivity materials in LWIR wavelength are transparent over visible wavelengths such that they can be applied to transparent substrates including (but not limited to) windows. In some embodiments, tuning the emissivity of interior surfaces to a relatively low emissivity at about 0.1 can decrease the set point temperature up to about 7° C. The decrease of the set point temperature can correspond to energy saving in accordance to various embodiments. In certain embodiments, low emissivity interior surfaces can achieve an energy saving of approximately 67.7% relative to high emissivity materials, which may have an emissivity of about 0.9. Many embodiments exhibit that in warm weather, tuning interior surfaces including (but not limited to) walls, floors, and ceilings to a high emissivity can result in energy savings relative to low emissivity surfaces of cooling systems. In several embodiments, high emissivity interior surfaces can have achieve about 38.5% energy savings relative to low emissivity surfaces.

Many embodiments reveal energy savings potential by better controlling the flows of heat that surround human occupants in the form of thermal radiation. Several embodiments demonstrate incorporating materials choices and/or structural parameters that enable emissivity tuning in the LWIR part of the electromagnetic spectrum.

With energy consumption for heating and cooling expected to grow dramatically worldwide, improving the efficiency of these systems may be an important part of mitigating climate change. One goal of heating and cooling in buildings with human occupants is to maintain their thermal comfort (See, e.g. Fanger, P. O., *Copenhagen: Danish Technical Press.,* 1970, the disclosure of which is incorporated herein by reference). Thermal comfort is both a quantitative and qualitative judgment that connects an individual's physiological and emotional perceptions of being in a thermally comfortable state (See, e.g. Fanger, P. O., *Copenhagen: Danish Technical Press.,* 1970; and Hansen, J., *Build Env.,* 1990, 24, 309-316, the disclosures of which are incorporated herein by reference).

While thermal comfort can be linked to the air temperature set point in a conditioned space, a human occupant's perception of comfort is subject to a range of other factors. These can include light intensity, material properties, metabolic heat production, heat transfer coefficients and radiative heat losses to external surfaces (See, e.g. Moon, J. H., et al., *Int. J. Therm. Sci.,* 2016, 107, 77-88; and Cheng, Y., et al., *Energy Build,* 2013, 64, 154-161, the disclosures of which are incorporated herein by reference). Human skin temperature is about 33° C. in comfortable conditions, while the average heat generation rate of a standing adult is about 70 $W/m^2$ (See, e.g. American Society of Heating, 2013 *Ashrae Handbook: Fundamentals,* 2013; and Okamoto, T., et al., Sci. Rep., 2017, 7, 11519, the disclosure of which are incorporated herein by reference). Previous work has examined how temperature, air velocity and humidity may affect thermal comfort (See, e.g. Coutts, A. M., et al., *Theor. Appl. Climatol.,* 2016, 124, 55-68; Yang, L., et al., *Appl. Energy,* 2014, 115, 164-173; and Rupp, R. F., *Energy Build.,* 2015, 105, 178-205, the disclosures of which are incorporated herein by reference). Given the complex array of factors that influence the perception of comfort, and the need for reducing energy use for heating and cooling, it is to be noted that an increase in the set point temperature for cooling, or a decrease in the set point for heating, by about 4° C. can reduce energy use by up to 45% and 35% respectively (See, e.g. Hoyt, T., et al., *In International Conference on Environmental Ergonomics,* 2009, 608-612, the disclosure of which is incorporated herein by reference).

In an indoor environment, where most people stay in a sedentary state, more than 50% of the heat generated by the human body is released through thermal radiation in the LWIR part of the spectrum (See, e.g. Cai, L., et al., *Nat. Comm.,* 2017, 8, 496; and Winslow, C.-E., et al., *Am. J. Physiol.,* 1939, 127, 505-518, the disclosures of which are incorporated herein by reference). The effect of radiative heat transfer on thermal comfort has been explored (See, e.g. Marino, C., et al., *Sol. Energy,* 2017, 144, 295-309; and Arslanoglu, N., et al., *Energy Build.,* 2016, 113, 23-29, the disclosures of which are incorporated herein by reference) but remains a comparatively untapped mechanism for efficiency gains. One approach can be tuning the radiative properties of clothing through optical approaches, making the clothing fabric more or less transparent to thermal radiation emitted from the human wearer, depending on weather conditions (See, e.g. Qiu, Q., et al., *Nano Energy,* 2019, 58, 750-758; Cai, L., et al., *Joule,* 2019; Zhou, H., et al., *Ind. Eng. Chem. Res.,* 2019; Yue, X., et al., *J. Colloid Interface Sci.,* 2019, 535, 363-370; Hsu, P. C., et al., *Science,* 2016, 353, 1019-1023; Guo, Y., et al., *ACS Appl. Mater. Interfaces,* 2016, 8, 4676-4683; Hsu, P.-C., et al., *Nano Lett.,* 2015, 15, 365-371; and Tong, J. K., et al., *ACS Photonics,* 2015, 2, 769-778, the disclosures of which are incorporated herein by reference). While conceptually attractive, this approach poses practical challenges, as it requires the human occupants of a conditioned space to wear specialized clothing depending on weather conditions. On the other hand, materials whose emissivity can be tuned in the LWIR part of the spectrum relevant to room temperature blackbody radiation, including by electrochromic control have been reported (See, e.g. Mulford, R. B., et al., *J. Heat Transfer,* 2019, 141, 32702; and Zhang, X., et al., *Sol. Energy Mater. Sol. Cells,* 2019, 200, 109916, the disclosures of which are incorporated herein by reference).

Many embodiments implement methods to make the environment surrounding the human occupants responsive to their radiative heat flows, and enable improved heating and cooling efficiency. In cold weather conditions, lower radiative heat loss from human occupants may be desirable, as the air temperature could then be maintained at a lower temperature for the same level of thermal comfort. In these conditions it would be preferable to have low emissivity (high reflectivity) materials in the interior surfaces including (but not limited to) floor, ceiling, windows and walls, surrounding an occupant. Low emissivity materials may have emissivity between about 0.1 to about 0.5 in LWIR wavelength in accordance with some embodiments. By contrast, in summer or warm weather conditions, the heat generated by a human should be dissipated to interior surfaces, as these surfaces are typically colder than skin temperature. Thus, high emissivity (and low reflectivity) materials of the surroundings would be desirable. High emissivity materials may have emissivity between about 0.5 to about 1 in LWIR wavelength in accordance with some embodiments. In winter, having low emissivity interior surfaces could reduce the heat loss of a radiator in a room with no human occupant (See, e.g. Robinson, A. J., et al., *Energy Build,* 2016, 127, 370-381, the disclosure of which is incorporated herein by reference). However, one main purpose of space heating and cooling is to ensure the thermal comfort of the human occupants inside. Previous studies lack the understanding of how much energy use can be reduced by controlling the thermal emissivity of interior surfaces, while maintaining the same thermal comfort level for human occupants of a conditioned space. Many embodiments show that the desired radiative properties can change from low emissivity to high emissivity depending on weather conditions and the heat load, enabling maximal heating and cooling efficiency year-round.

Many embodiments implement tunable emissivity surfaces for interior spaces in built environment. To evaluate the possible set point change and thus energy savings, several embodiments implement computational fluid dynamics (CFD) simulations of an office environment with a human occupant. In some embodiments, the emissivity of the inner walls can be tuned from that of a near blackbody to a very low value. Several embodiments exhibit that in cold weather conditions a decrease in the set point of up to about 7° C. relative to conventional materials if a low emissivity surface is used. Certain embodiments show that a decrease of up to about 10° C. in the set point when multiple occupants are in the conditioned space. Conversely, in warm weather conditions, a number of embodiments show that an increase in the set point of up to about 4° C. can be achieved when the emissivity of the interior surfaces increases to a high value.

Many embodiments analyze the building scale to evaluate the impact of heating and cooling energy use on a typical summer and winter day in a temperate climate. Building scale analysis can be done using EnergyPlus™ (See, e.g. Kant, K., et al., *Sustain. Through Energy-Efficient Build.,* 2018, 209-223; Yu, Y., et al., *Building Simulation,* 2019, 12, 347-363; and Shen, P., et al., Energy, 2019, 173, 75-91, the disclosures of which are incorporated herein by reference). In some embodiments, a low-emissivity interior surface can result in up to about 67.7% energy savings relative to conventional materials, when heating is needed. Several embodiments show that in warm weather conditions however low emissivity interior surfaces are no longer appropriate and would result in about 38.5% energy penalty relative to high emissivity interior surfaces. Thus, tuning the interior surface's thermal emissivity can enable maximal energy efficiency throughout the year, and in response to varying heat loads and conditions in accordance with a number of embodiments.

Tunable Emissivity Interior Surfaces

Figure 1A:
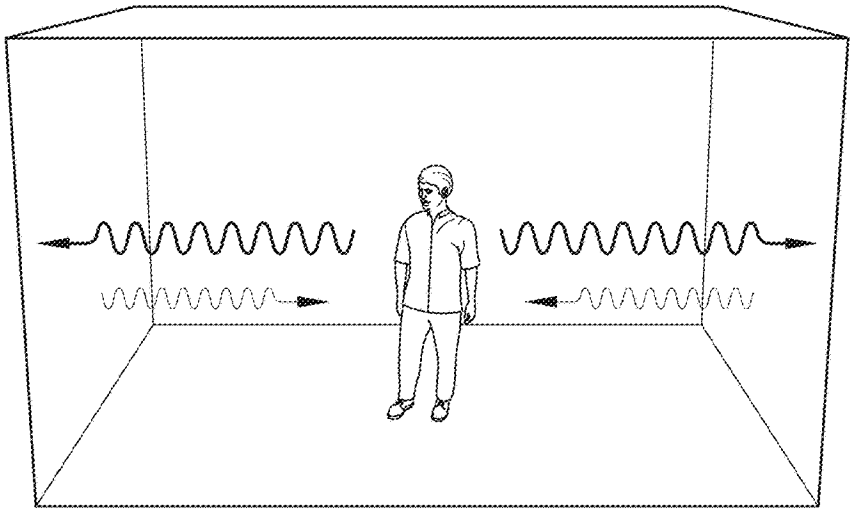

Many embodiments implement reducing radiative heat loss in interior spaces to keep occupants comfortable at lower air temperatures. In cold weather conditions, the human body can lose a significant amount of heat through both convective and radiative heat transfer to its surroundings. Since more than half this heat loss is from thermal radiation (See, e.g. Marino, C., et al., *Sol. Energy,* 2017, 144, 295-309, the disclosure of which is incorporated herein by reference), embodiments according to the instant disclosure show reducing radiative heat loss in interior spaces can be an effective way to keep occupants comfortable at lower air temperatures. Most building materials including (but not limited to) paints have high emissivity (and absorptivity) in the LWIR wavelength. Thus interior surfaces can absorb the thermal radiation from the human occupant and emit back a smaller amount of thermal radiation corresponding to the lower temperature of the walls, ceilings and floors. An example of having low emissivity, high reflectivity, interior surfaces in cold-weather conditions in accordance with an embodiment of the invention is schematically illustrated in FIG. 1A. The interior surfaces can send back a large fraction of the radiative heat lost by the human occupant back to them, allowing lower air temperature setting, thereby reducing the need for heating energy while maintaining the same level of thermal comfort. Many embodiments assess the level of thermal comfort by the maintenance of constant skin temperature and fixed amount of body heat released by the human occupant.

By contrast, in summer and warm-weather conditions more generally, it is desirable to maximize the net heat rejected by the human occupant to their environment. An example of having high emissivity, high absorptivity, interior surfaces in warm-weather conditions in accordance with an embodiment of the invention is schematically illustrated in FIG. 1B. High emissivity (high absorptivity) materials in the interior of the building can be used to absorb the heat radiated by the occupant. By doing so one can maintain the same level of thermal comfort while using less cooling energy than it would be needed if the walls were low emissivity or high reflectivity. In many embodiments, tunability in the emissivity of the surfaces surrounding human occupants can optimize heat losses and/or heat savings depending on weather conditions and overall heat loads.

Computer Fluid Dynamics Simulations

Figure 2:
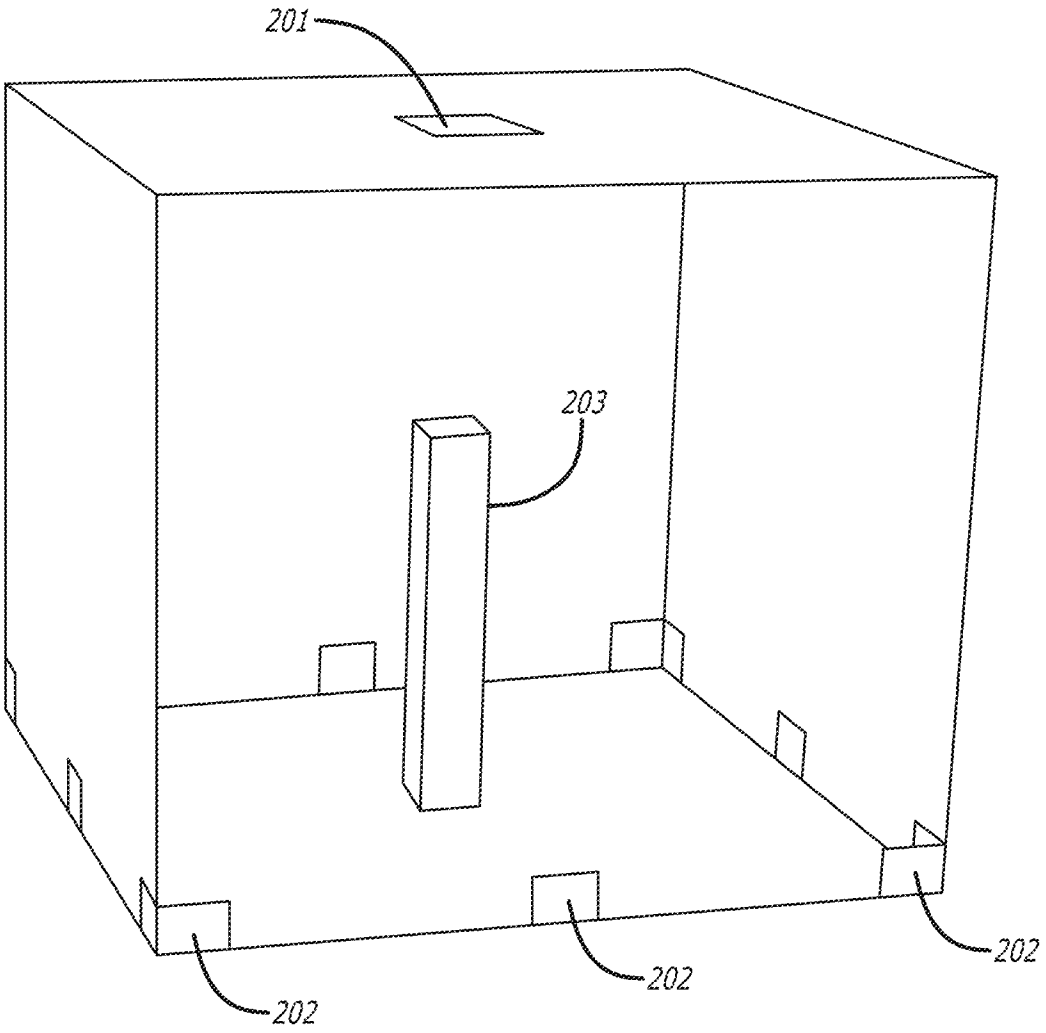
FIG. 2 illustrates a 3D computational model simulating a single occupant standing in a conditioned space, to assess the impact of tuning the thermal emissivity of the spaces that surround the human occupant in accordance with embodiments.

Many embodiments analyze the impact of emissivity on the interior air temperature set point. An example of a 3D computational model to simulate a standing person in a proto-typical conditioned space in accordance with an embodiment of the invention is illustrated in FIG. 2. The room, with dimensions of about 3 m×3 m×3 m, has an air inlet (201) where heating or cooling air is supplied, and multiple outlets (202) to ensure adequate distribution and flow of air in the space. In winter, the heating air comes through the inlet, heats the room, and then comes out the room through the outlets. In summer, the cooling air comes from the inlet, cools the room, and then exits through outlets. The human occupant (203) can be modeled as a volume heat source of about 103 W (See, e.g. Marino, C., et al., *Sol. Energy,* 2017, 144, 295-309, the disclosure of which is incorporated herein by reference). The occupant is set to have 1.0 clo and 0.6 clo clothing insulation in the cold weather and warm weather case respectively (See, e.g. Takada, S., et al., *Build. Environ.,* 2016, 99, 210-220; and Oğulata, R. T., et al., *Fibres Text. East. Eur.,* 2007, 15, 61, the disclosures of which are incorporated herein by reference). The wall temperature is set as a constant value during the simulation to capture its large thermal mass and typical observed behavior in commercial buildings.

To assess the change in set point temperature as a function of emissivity, the air temperature can be adjusted to maintain a skin temperature of about 33° C. in response to the change in the emissivity of the interior surfaces. The possible change in air temperature set point can be determined while maintaining the human occupant's thermal comfort. For a closed system with two gray and diffuse surfaces, the radiative heat flux of the two surfaces can be analytically described as:

$$Q_{1,2} = \frac{E_{b1} - E_{b2}}{\frac{1-\varepsilon_1}{\varepsilon_1 A_1} + \frac{1}{X_{1,2} A_1} + \frac{1-\varepsilon_2}{\varepsilon_2 A_2}} \quad (1)$$

In the equation (1), $Q_{1,2}$ is the heat flux, $A_1$ is the area of the hot surface and $A_2$ is the sum of the three cold surfaces area, $E_{b1}$ and $E_{b2}$ are the black body emission at the temperature of hot surface and cold surface respectively, $\varepsilon_1$ and $\varepsilon_2$ are the emissivity of the hot surface and the cold surface, X is the view factor. When surface 1 is a plane or convex equation (1) can be simplified as:

$$Q = \frac{A_1(E_{b1} - E_{b2})}{\frac{1}{\varepsilon_1} + \frac{A_1}{A_2}\left(\frac{1}{\varepsilon_2} - 1\right)} \quad (2)$$

equation (2) can be used as a simplified way to calculate the radiative heat transfer between the occupant and their surroundings. Equation (2) shows that the decrease of the emissivity of the cold surface can result in the decreased heat flux as well.

Low Emissivity Surfaces Under Cold Weather Conditions

In the winter, or cold-weather conditions more generally, the temperature of the walls in the interior space can be set to 13° C. (See, e.g. ANSI/ASHRAE, *Ashrae,* 2013, 58, the disclosure of which is incorporated herein by reference). The heater is turned on and heating air is delivered through the inlet to the room. At the same time, the occupant inside is exchanging heat both through convection to the air and radiation to the surrounding interior surfaces. While the temperature of the occupant and the surrounding interior surfaces are difficult to change, the emissivity of the walls can be adjusted to reduce the radiative loss in accordance to several embodiments.

Figure 3A:
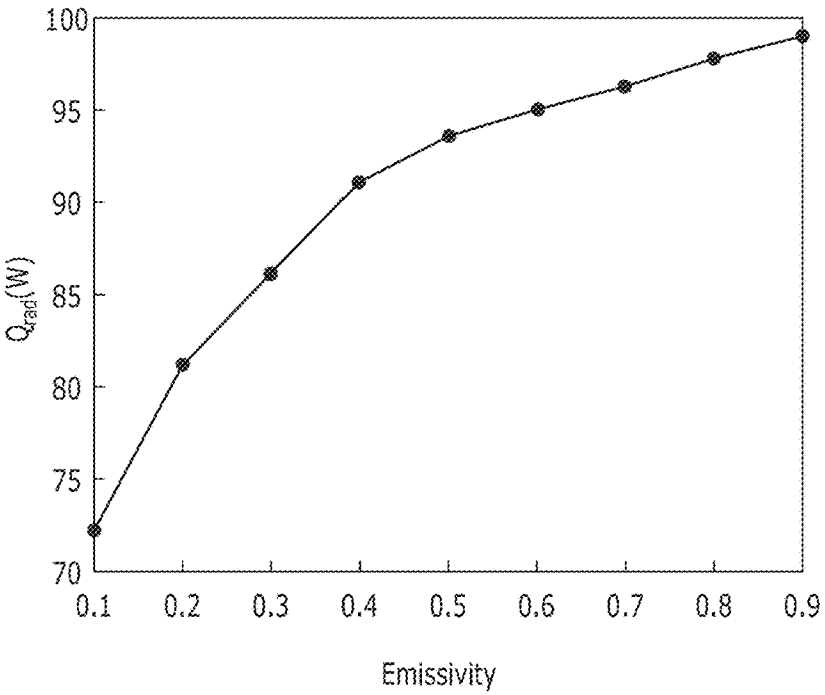
FIG. 3*a* illustrates under the cold weather and single-occupant condition, radiative heat loss of the occupant decreases with the emissivity of their surroundings in accordance with embodiments.

In many embodiments, the CFD models can determine the radiative heat exchange between the occupant and the surrounding surfaces as a function of emissivity. An example of radiative heat loss in response to interior surfaces of different emissivity in accordance with an embodiment of the invention is illustrated in FIG. 3A. The radiative heat loss from the occupant can be reduced from about 99.1 W to about 72.3 W when the emissivity is decreased from about 0.9 to about 0.1 in accordance with some embodiments. The heat loss response to the emissivity change matches well with the analytical model of equation (2). When the interior surfaces have a lower $£_2$, the radiative heat loss can be decreased.

Figure 3B:
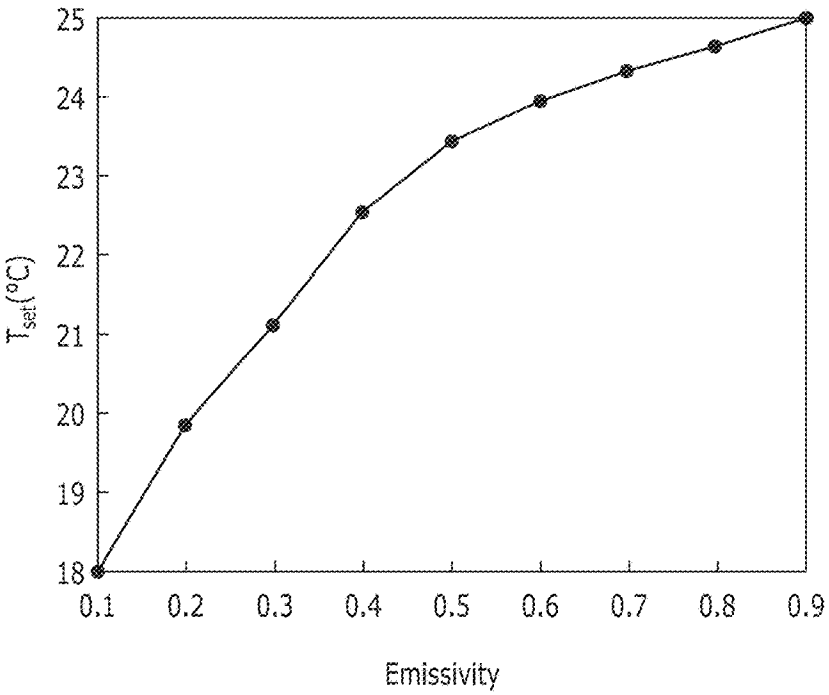
FIG. 3*b* illustrates under the cold weather and single-occupant condition, the set point temperature for heating decreases by 7° C. as the emissivity of the interior surfaces surrounding the human occupant go from 0.9 to 0.1 in accordance with embodiments.

In several embodiments, since the occupant's heat loss is reduced, the set point temperature can be decreased to save heating energy. An example of set point temperature in response to interior surfaces of different emissivity in accordance with an embodiment of the invention is illustrated in FIG. 3B. The set point temperature decreases from about 25° C. to about 18° C., when the emissivity is tuned from 0.9 to 0.1 in accordance with certain embodiments. Several embodiments exhibit that a common trend shown in FIG. 3A and FIG. 3B is that the rate of change of both the radiative heat loss (FIG. 3A) and set point temperature reduction (FIG. 3B) can be accelerated when the emissivity approaches 0. Equation (2) shows that as $E_2$ approaches zero, the impact of the denominator increases sharply.

High Emissivity Surfaces Under Warm Weather Conditions

Figure 4A:
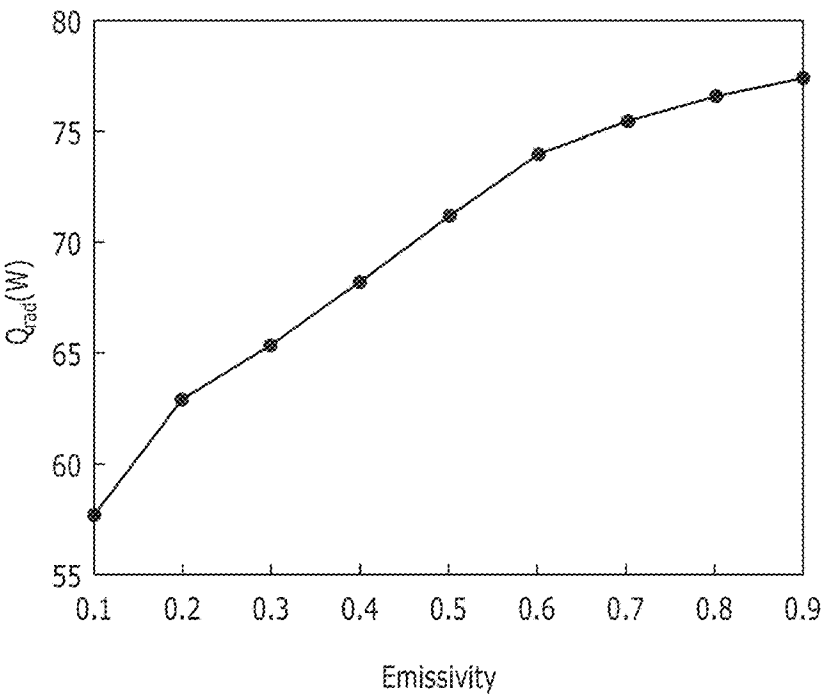
FIG. 4*a* illustrates under warm weather and single-occupant condition, radiative heat loss of the occupant increases with the emissivity of their surroundings in accordance with embodiments.

In warm weather conditions, the temperature of the walls can be set to 20° C. (See, e.g. Joudi, A., *Appl. Energy,* 2011, 88, 4655-4666, the disclosure of which is incorporated herein by reference), which is lower than human skin temperature. The air conditioner is turned on and cooling air is delivered through inlet to the room. An example of radiative heat flux between the occupant and the surrounding walls as a function of emissivity in accordance with an embodiment of the invention is illustrated in FIG. 4A. The heat released radiatively from the occupant increases significantly when the emissivity of the walls goes to near that of a blackbody (emissivity about 0.9). The radiative heat loss increases from about 57.7 W for an emissivity of about 0.1 to about 77.2 W when the emissivity is about 0.9 in accordance with some embodiments. This trend corresponds well with equation (2).

Figure 4B:
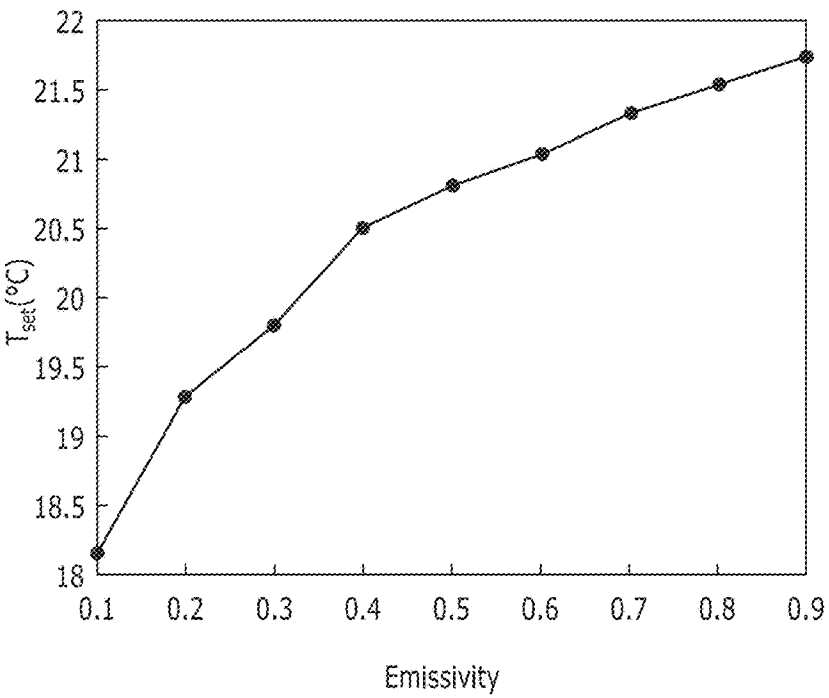
FIG. 4*b* illustrates under the warm weather and single-occupant condition, the set point temperature for cooling increases about 4° C. as the emissivity of the interior surfaces surrounding the human occupant increases from 0.1 to 0.9. in accordance with embodiments.

In several embodiments, since the occupant can release more heat through radiation at a higher interior surface emissivity, the cooling temperature set point can thus be increased to save energy. An example of set point temperature and the surrounding walls as a function of emissivity in accordance with an embodiment of the invention is illustrated in FIG. 4B. The set point temperature can rise up to about 4° C., from 18° C. to 22° C. when the emissivity increases from about 0.1 to about 0.9.

Interior Space with Multiple Occupants

Figure 5:
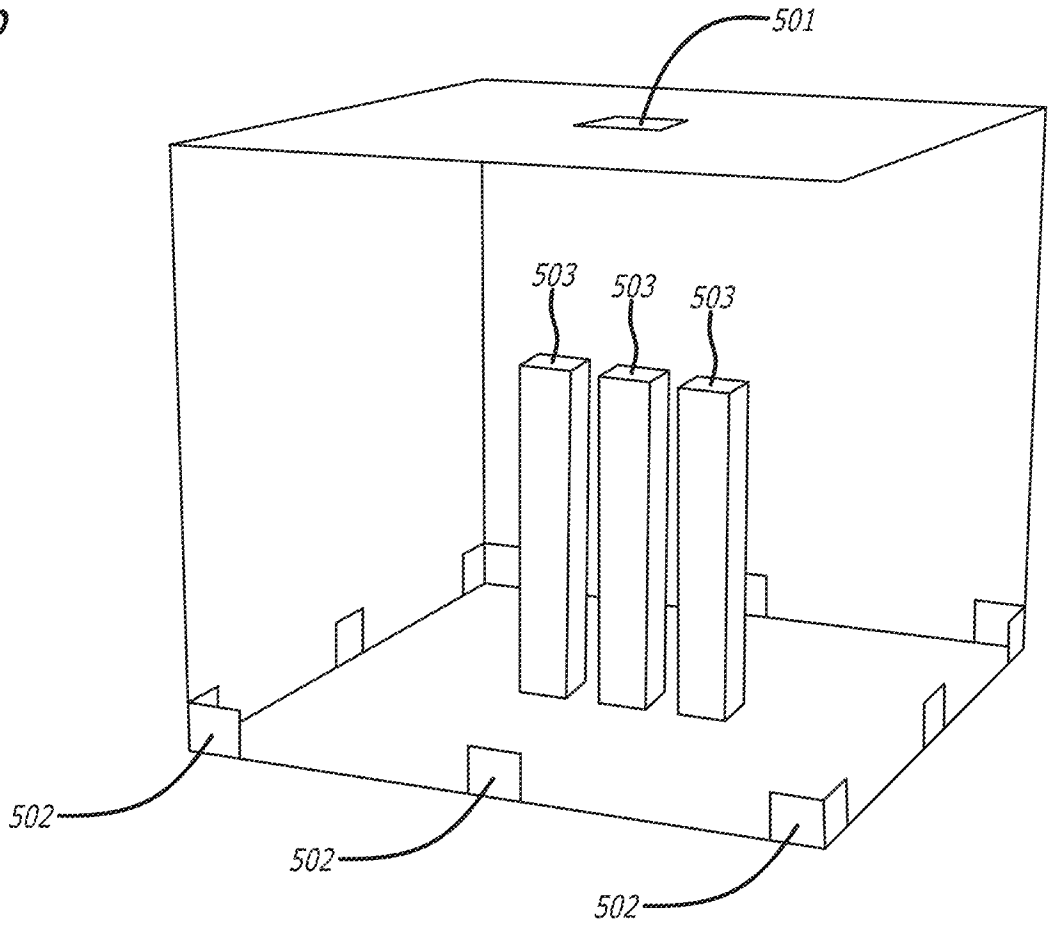
FIG. 5 illustrates a 3D computational model simulating multiple occupants standing in a conditioned space, to assess the impact of tuning the thermal emissivity of the spaces that surround the human occupant in accordance with embodiments.

Many embodiments investigate the presence of more than one occupant in an interior space. An example of more than one standing person in a proto-typical conditioned space in accordance with an embodiment of the invention is illustrated in FIG. 5. The room has an air inlet (501) where heating or cooling air is supplied, and multiple outlets (502) to ensure adequate distribution and flow of air in the space. In winter, the heating air comes through the inlet, heats the room, and then comes out the room through the outlets. In summer, the cooling air comes from the inlet, cools the room, and then exits through outlets. Multiple human occupants (503) are placed inside the room. The multiple occupants scenario is implemented numerically in both cold weather and warm weather conditions. When there is more than one occupant in the same room, the heat source can be effectively multiplied and there is not only heat transfer between occupant and surroundings, but also between occupants in accordance with many embodiments. In typical cases, such as a classroom or movie theater, the space between different occupants is quite narrow. If the multiple occupants are treated as one and larger heat source, the emissivity effect will be enhanced according to equation (2) because of the area of the hot object increases. Extending this analysis when multiple occupants are in a same room, the low emissivity walls will not only reflect the radiative heat back but also the occupants' heat to them, which makes the occupants feel warmer than single occupant case. On the other hand, in summer, if the walls reflect most of the radiative heat back, the multiple occupants can result in a significant cooling load for the air conditioner. However, if the walls can absorb most of the heat, the energy used in cooling can be substantially decreased.

Figure 6A:
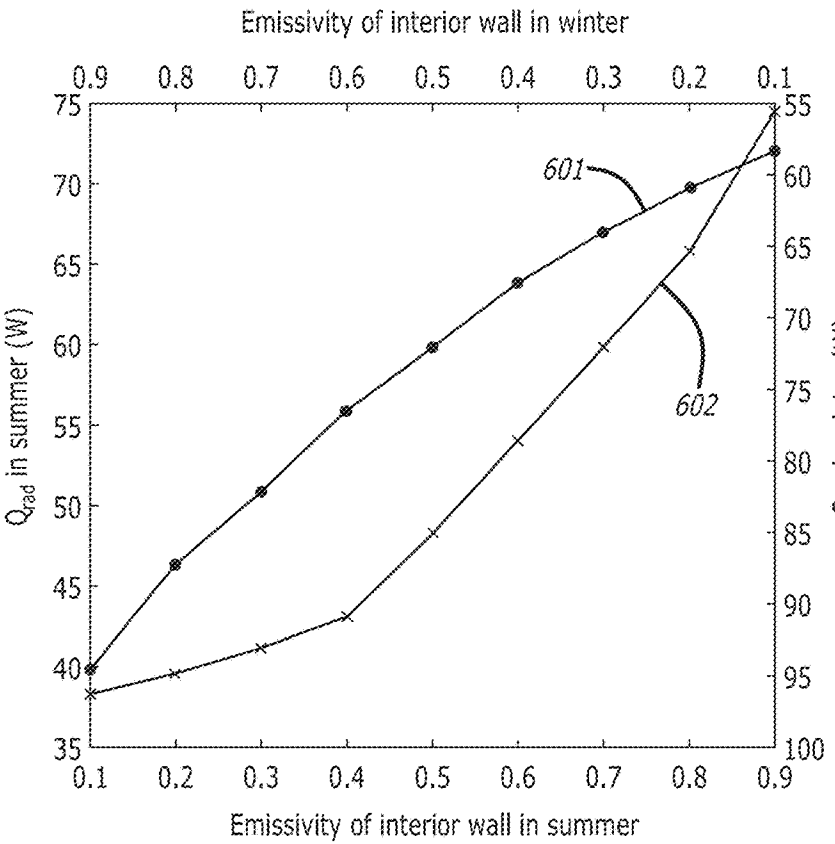
FIG. 6*a* illustrates the radiative heat loss as a function of emissivity in both cold weather and warm weather conditions in accordance with embodiments.

An example of the radiative heat flux resulting from varying emissivity from 0.1 to 0.9 in both winter and summer in accordance with an embodiment of the invention is shown in FIG. 6A. In the cold weather case shown in FIG. 6A, 602 shows the average radiative heat loss of each occupant decreases from about 96.2 W to about 55.5 W when the emissivity decreases from 0.9 to 0.1. There is also an acceleration of change after emissivity goes below than 0.3. In the warm weather case, 601 shows the radiative heat loss of each occupant is increased from about 39.9 W to about 72.1 W when the emissivity increases from 0.1 to 0.9. There is also an acceleration in the heat transfer reduction as emissivity goes below than 0.3.

Figure 6B:
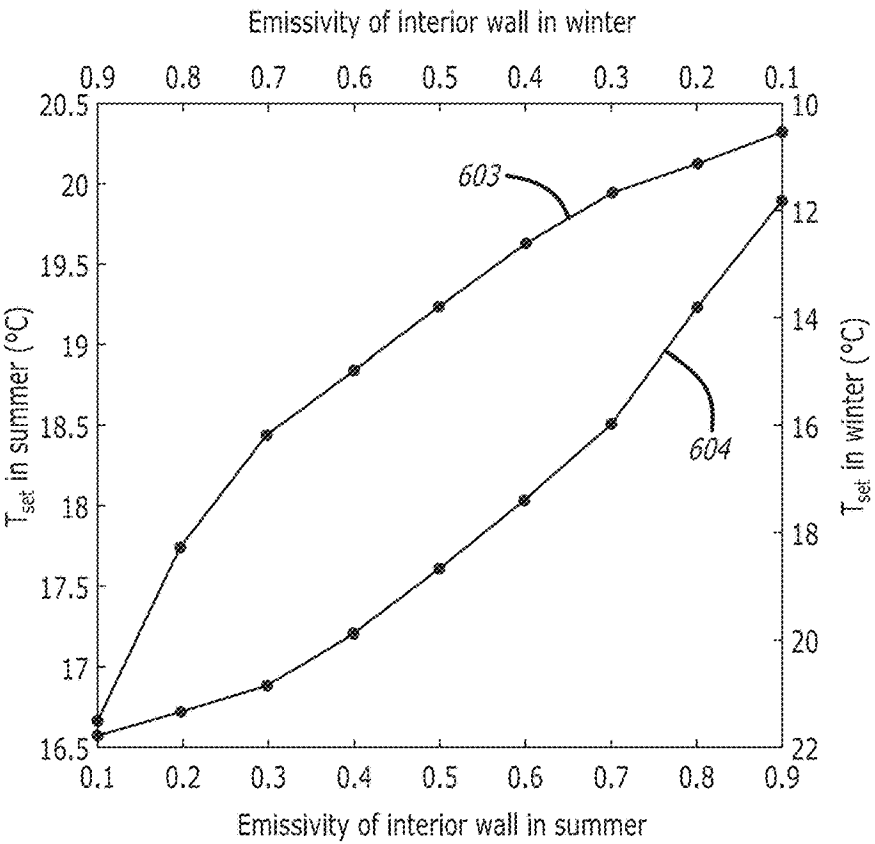
FIG. 6*b* illustrate the heating set point decreases from about 22° C. for an emissivity of about 0.9 to about 12° C. for an emissivity of about 0.1, while the cooling set point increases from about 16.5° C. to about 20.5° C. as the emissivity increases from about 0.1 to about 0.9 in accordance with embodiments.

An example of the set point temperature change resulting from varying emissivity from 0.1 to 0.9 in both winter and summer in accordance with an embodiment of the invention is shown in FIG. 6B. In the cold weather conditions shown in FIG. 6B, 604 shows a set point temperature decrease of about 10° C. when the emissivity decreases from 0.9 to 0.1. In the warm weather conditions, 603 shows a set point temperature decrease of up to about 3.8° C. when the emissivity decreases from 0.9 to 0.1, necessitating substantially more cooling. Several embodiments show that in dense spaces like classrooms, theaters and indoor stadiums, a significant amount of energy can be saved by implementing a tunable emissivity surface on the walls, ceilings and floors.

Energy Savings with Tunable Emissivity Interior Surfaces

Figure 7:
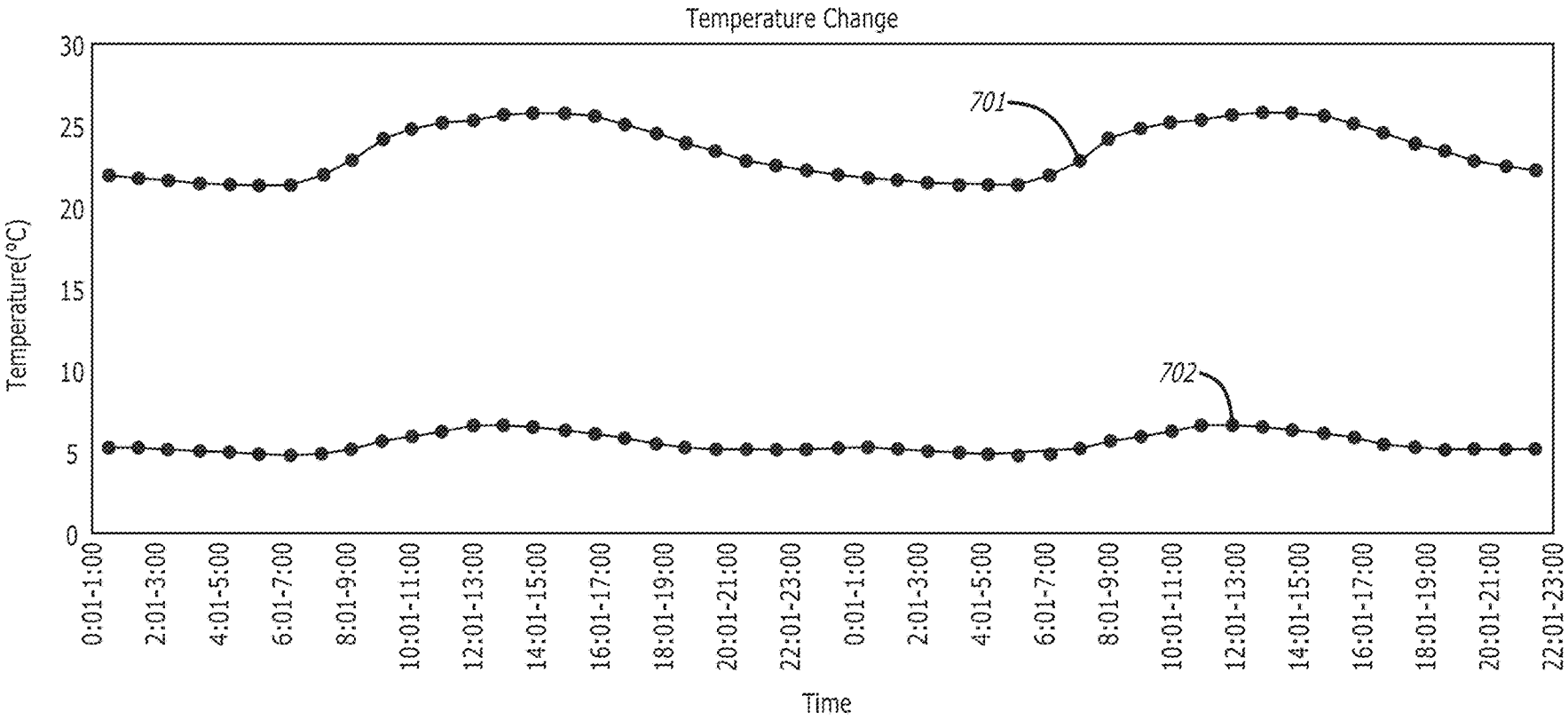
FIG. 7 (Prior Art)
FIG. 7 illustrates the air temperatures in August and December in Ancona, Italy over a 24-hour period in accordance with the prior art.

Many embodiments assess the building-level energy savings with tunable emissivity interior surfaces. Energy savings assessment can be analyzed using EnergyPlus™, a building energy analysis tool (See, e.g. Fumo, N., Energy and Buildings, 2010, 42, 2331-2337, the disclosure of which is incorporated herein by reference). The CFD simulation results are applied to EnergyPlus™. Several embodiments estimate the energy savings in a hotel-type commercial building if it uses tunable emissivity interior surfaces. A small hotel reference building located in Ancona, Italy is used as the simulated environment. This hotel has a low window/wall ratio (184.2 $m^2$/1, 695 $m^2$) making it similar overall to the structure simulated in CFD analysis (See, e.g. Commercial Reference Buildings, Office of Energy Efficiency & Renewable Energy, the disclosure of which is incorporated herein by reference). Furthermore, Ancona has both a cold winter and a hot summer, allowing to assess both heating and cooling energy savings. The analysis period is a typical day in August for warm weather conditions, and December for cold weather conditions (See, e.g. Commercial Reference Buildings, Office of Energy Efficiency & Renewable Energy, the disclosure of which is incorporated herein by reference). FIG. 7 shows the average air temperature in the August (701) and December (702), corresponding to weather patterns common in a wide range of temperate climates throughout the world.

Figure 8:
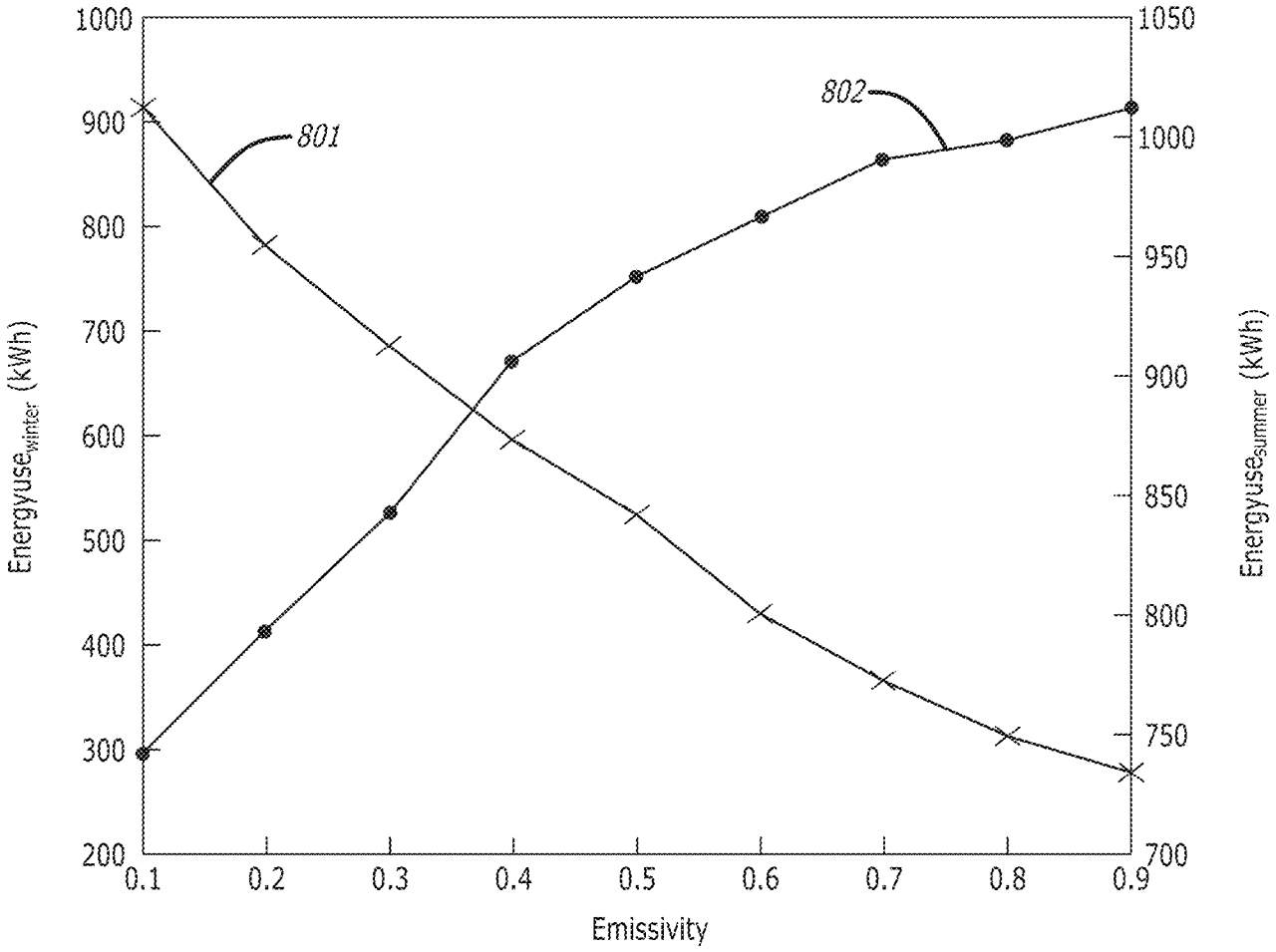
FIG. 8 illustrates energy savings as a function of interior surface emissivity for energy use variation for heating and cooling in a building in winter and summer in accordance with embodiments.

Many embodiments use the change in set point temperature associated with a change in the interior surfaces emissivity from 0.9 to 0.1 in winter, to model the change in heating energy use as a function of emissivity. Several embodiments use the change in set point temperature associated with a change in the interior surfaces emissivity from 0.9 to 0.1 in summer, to model the change in cooling energy use as a function of emissivity. An example of energy used for heating in winter and for cooling in summer as a function of emissivity in accordance with an embodiment of the invention is illustrated in FIG. 8. 801 shows the energy used for heating decreases from about 910 kWh to about 300 kWh, when the emissivity decreases from 0.9 to 0.1. The decrease in energy used in cold weather conditions corresponds to about 67.7% savings in heating energy. Conversely, during the summer day modeled, 802 shows the cooling energy use increases from about 740 kWh to about 1050 kWh when the emissivity changes from 0.9 to 0.1. The energy increase leads to about 38.5% energy penalty if the low emissivity interior surfaces are not tuned back to high emissivity ones. Some embodiments implement emissivity tunability may be necessary within a single day depending on variable weather conditions between day and night, and variable occupancy and heat loads.

EXEMPLARY EMBODIMENTS

The following embodiments provide specific combinations of materials and structures that enable tuning emissivity in the long-wave infrared part of the electromagnetic spectrum. Many embodiments implement materials with electrochromic properties to tune emissivity over LWIR wavelengths. It will be understood that the specific embodiments are provided for exemplary purposes and are not limiting to the overall scope of the disclosure, which must be considered in light of the entire specification, figures and claims.

Example 1: Conducting Polymers

Many embodiments implement conducting polymers applied to interior surfaces for tunable emissivity. Examples of conducting polymers with tunable emissivity in the LWIR spectrum include (but are not limited to): poly(3,4-ethylenedioxythiophene) tosylate (PEDOT), poly(3,4-ethylenedioxythiophene) tosylate (PEDOT:Tos), poly(3,4-ethylenedioxythiophene) polystyrene sulfonate (PEDOT:PSS) and polyaniline. In several embodiments conducting polymer can be applied to the interior surfaces. In many embodiments, emissivity of the tunable materials in LWIR wavelengths can be tuned electrically including (but not limited to) by applying a voltage. A voltage can be applied to the film and thereby changing its state from a high emittance to low emittance one. Applied voltage may change the doping concentrations of conducting polymer and hence tune the emissivity in accordance with some embodiments. In some embodiments, flexible electrodes made of conducting polymer on flexible substrates could enable roll to roll applications. Certain embodiments implement flexible electrodes comprising (PEDOT:PSS) deposited on a PET and/or plastic substrate. Some embodiments implement polyaniline on the interior surfaces. Polyaniline can exhibit a contrast in emissivity in the long-wave infrared when a voltage is applied. IR electrochromic devices assembled using those polymers could have applications in thermal camouflage and control.

Figure 9:
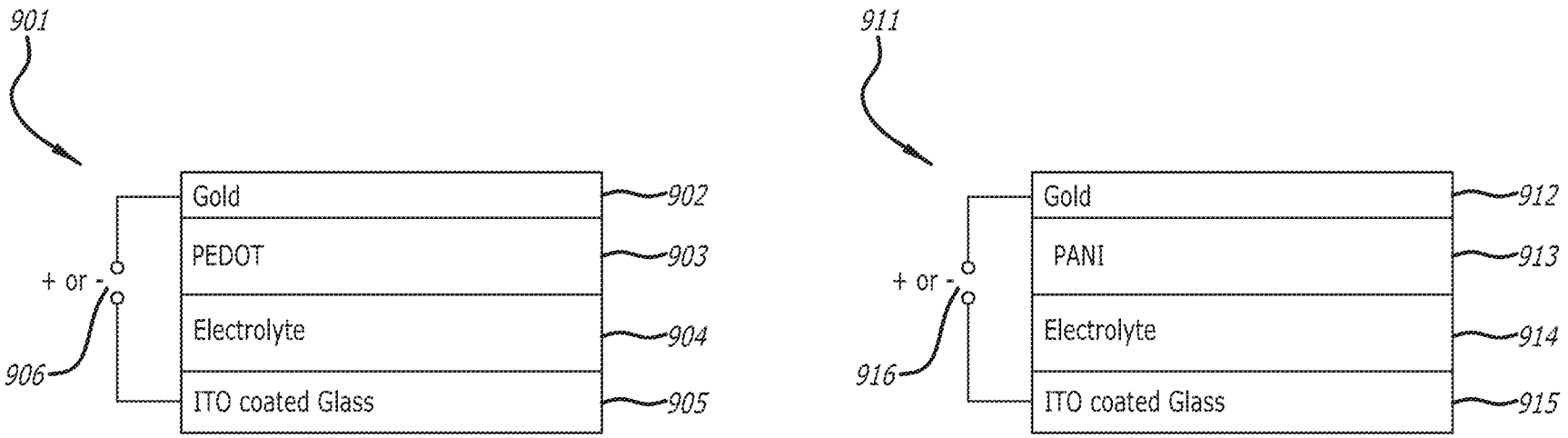
FIG. 9 illustrates tunable emissivity devices incorporating conducting polymers in accordance with embodiments.

An example of tunable emissivity devices incorporating conducting polymers in accordance with an embodiment of the invention is illustrated in FIG. 9. 901 in FIG. 9 illustrates a device incorporating poly(3,4-ethylenedioxythiophene) (PEDOT) conducting polymer. The top layer 902 is a gold film acting as one electrode. The gold film can be about 10 nm thick. The thin gold layers can enable infrared wave transmits through without significant loss in accordance with some embodiments. The second layer 903 is PEDOT, and third layer 904 is a solid electrolyte comprising $LiClO_4$. The fourth layer 905 is ITO coated glass acting as counter electrodes. A voltage source 906 can be used to apply voltage to tune emissivity of PEDOT.

911 in FIG. 9 illustrates a device incorporating $HClO_4$-doped polyaniline (PANI) conducting polymer. The top layer 912 is a gold film acting as one electrode. The gold film can be about 10 nm thick. The thin gold layers can enable infrared wave transmits through without significant loss in accordance with some embodiments. The second layer 913 is $HClO_4$-doped polyaniline, and third layer 914 is a solid electrolyte comprising $HClO_4$. The fourth layer 915 is ITO coated glass acting as counter electrodes. A voltage source 916 can be used to apply voltage to tune emissivity of PANI.

In some embodiments, the doping concentration of conducting polymers can affect emissivity in LWIR wavelengths. Several embodiments show that doped conducting polymer can have a relatively low emissivity in LWIR ranges while undoped conducting polymer may have a relatively high emissivity. Many embodiments demonstrate that doped and undoped states of electrochromic polymers can yield high and low emissivity in the LWIR wavelengths for controlling radiative heat flows between humans and their surroundings. By fitting the Drude model:

$$\varepsilon(\omega, z) = \left(1 + \frac{\omega_p^2}{(\omega - i\gamma)\omega)}\right), \tag{3}$$

where $$\omega_p = \sqrt{\frac{4\pi ne^2}{m^*}}$$

is the Drude plasma frequency with m*being the effective mass of the free carriers, n is the free carriers' concentration and e is the carrier charge, emissivity of conducting polymers by transfer matrix method can be calculated.

Figure 10A:
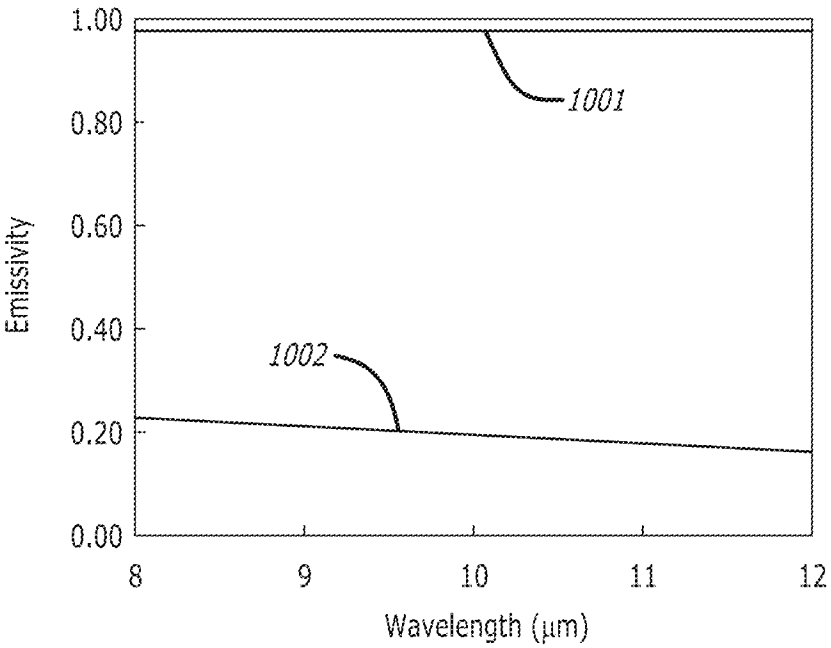
FIGS. 10*a* and 10*b* illustrate emissivity of PEDOT and PANI layers in doped and undoped states in accordance with embodiments.

An example of emissivity of PEDOT in doped and undoped state by applying positive and negative voltage in accordance with an embodiment of the invention is illustrated in FIG. 10A. 1001 shows undoped PEDOT has relatively high emissivity at about 1.0 in the LWIR wavelength ranges between 8 μm and 12 μm. 1002 shows doped PEDOT has relatively low emissivity at about 0.2 in the LWIR wavelength ranges between 8 μm and 12 μm. FIG. 10A shows a significant contrast between doped and undoped state of PEDOT by applying positive or negative voltage.

Figure 10B:
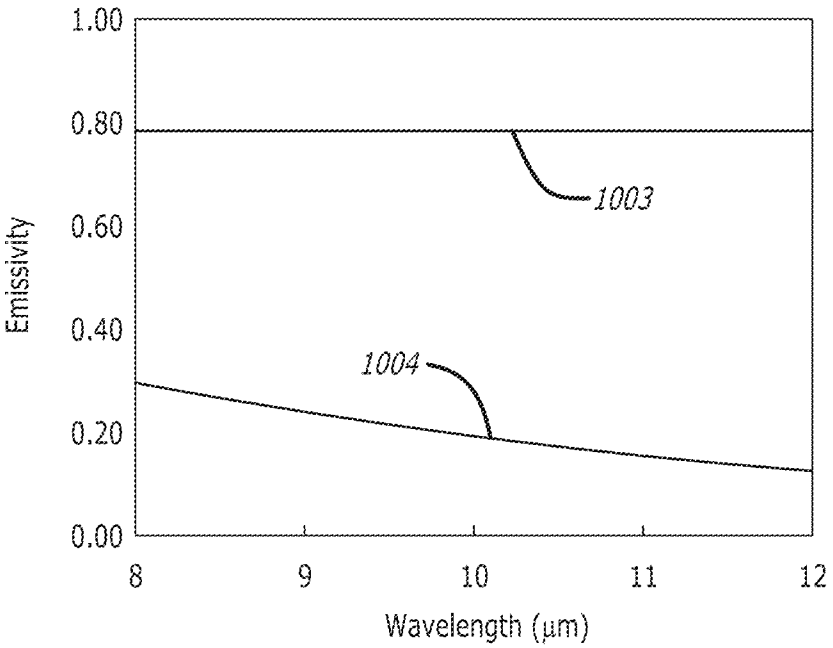

An example of emissivity of PANI in doped and undoped state by applying positive and negative voltage in accordance with an embodiment of the invention is illustrated in FIG. 10B. 1003 shows undoped PANI has relatively high emissivity at about 0.8 in the LWIR wavelength ranges between 8 μm and 12 μm. 1004 shows doped PANI has relatively low emissivity from about 0.1 to about 0.3 in the LWIR wavelength ranges between 8 μm and 12 μm. FIG. 10B shows a significant contrast between doped and undoped state of PANI by applying positive or negative voltage.

Example 2: Inorganic Oxides

Some embodiments implement inorganic oxides on the interior surfaces to tune emissivity. In many embodiments, inorganic oxide materials include tungsten trioxide ($WO_3$). Certain embodiments implement hydrogen tungsten bronzes ($H_xWO_3$). The materials can experience a contrast in emissivity in the long-wave infrared when a voltage is applied in accordance to a number of embodiments.

Many embodiments utilize thermochromic materials to interior surfaces for tunable emissivity. Several embodiments implement vanadium dioxide for tuning emissivity in interior spaces. In some embodiments, ion-irradiated vanadium dioxide can experience a phase-change temperature near room temperature, thus enabling interior surfaces including (but not limited to) walls to natural turn from high to low emissivity as it cools down from a warm temperature.

Example 3: Lithium Titanate

Many embodiments implement Lithium Titanate (LTO) as tunable emissivity materials. In several embodiments, LTO can have a state change in an electrochemical cell, going for being lithiated to de-lithiated, which can induce a change in its emissivity.

Figure 11:
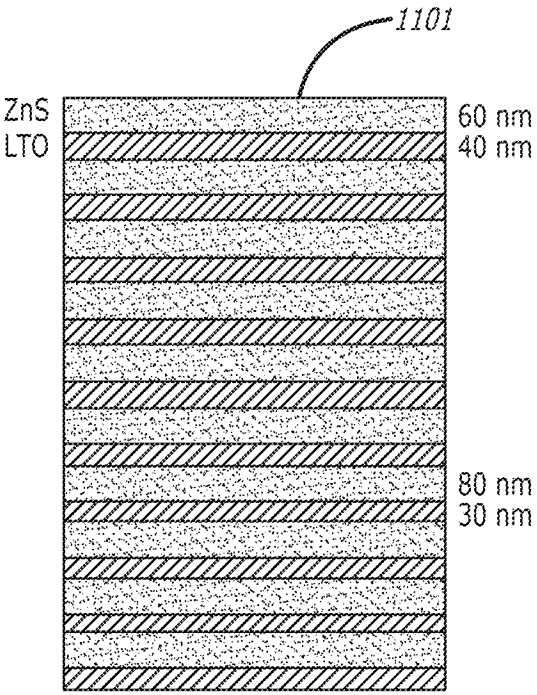
FIG. 11 illustrates transfer matrix electromagnetic simulation of 1D photonic design of alternating thin layers of ZnS and LTO to enhance emissivity contrast in accordance with embodiments.
Figure 11:
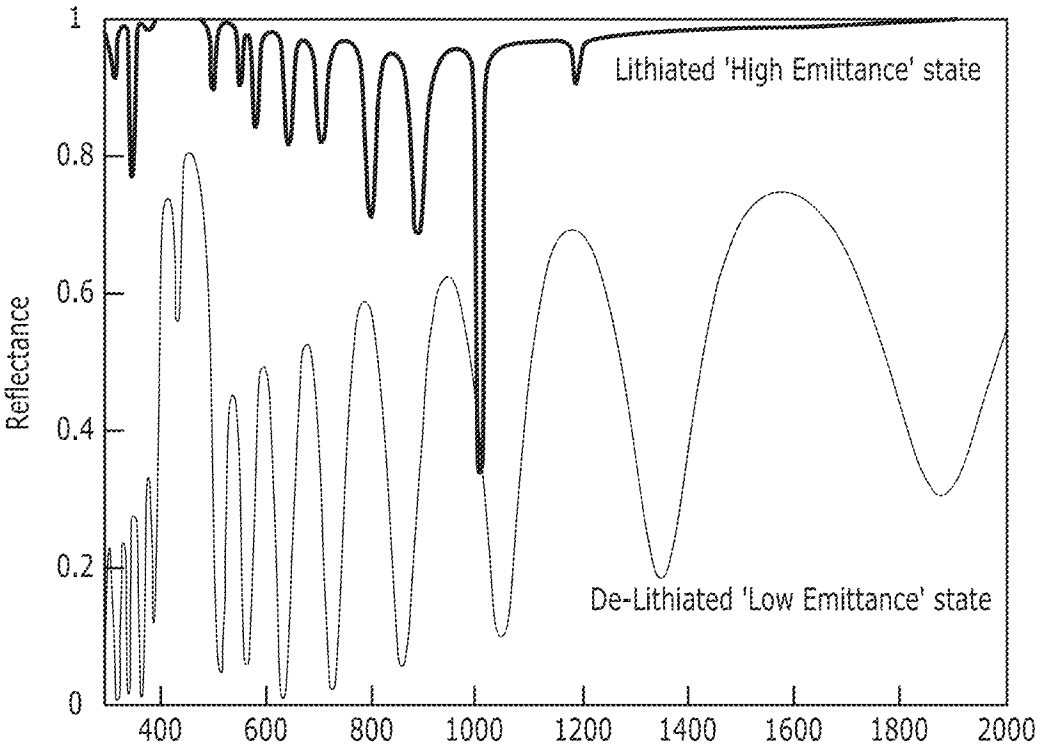

In several embodiments, a 1D photonic design can be used to enhance emissivity contrast. An example of transfer matrix electromagnetic simulation of 1D photonic design in accordance with an embodiment is shown in FIG. 11. The structure of 1D photonic design including alternating thin layers of ZnS and LTO (1101) can enable two capabilities. In the lithiated state, thermal emittance from the LTO is high. The ZnS structured with the LTO in varying thicknesses, a chirped and/or an aperiodic photonic crystal architecture, enables high reflectance over the solar spectrum, even though LTO presents high intrinsic solar absorption. In the de-lithiated state, LTO is effectively a wide-bandgap semiconductor. The ZnS does not alter its low infrared emissivity, but it can augment its solar absorption by virtue of the index contrast between LTO and ZnS. This then allows imparting visual color to an occupant of an interior space while altering the infrared emissivity for heat transfer purposes.

Example 4: Mechanical Devices

In several embodiments, tunable emissivity materials can be incorporated in mechanical devices. Emissivity in LWIR ranges can be tuned mechanically in accordance with certain embodiments. In a number of embodiments, low emissivity and high emissivity materials can be applied to different sides of mechanical devices, and different sides can be rotated between low emissivity and high emissivity states in response to the weather.

Figure 12:
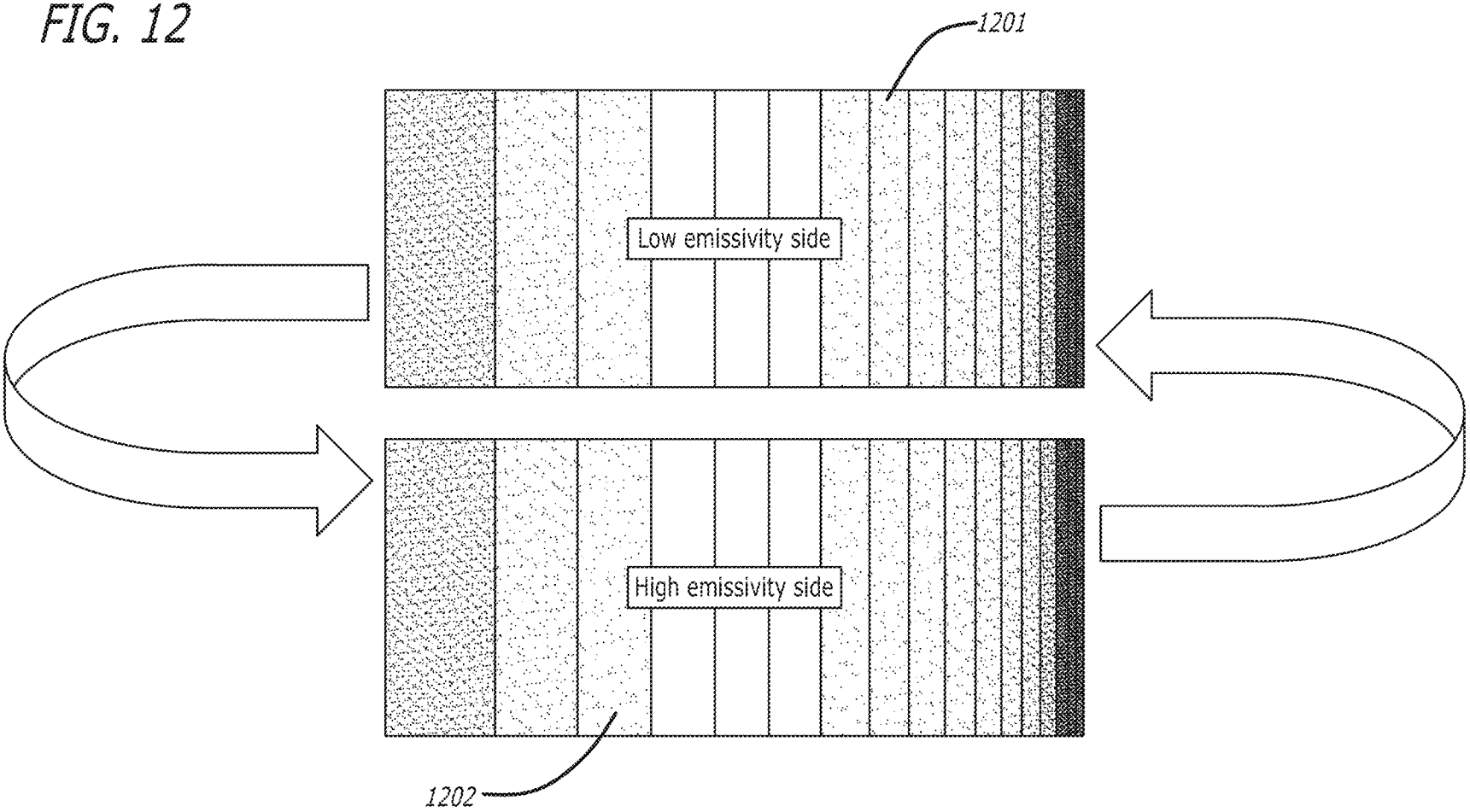
FIG. 12 illustrates switchable emissivity blinds by coating the two sides with different emissivity paintings in accordance with embodiments.

An example of a mechanical blinds device with two sides coated with low and high emissivity paint respectively in accordance with an embodiment of the invention is illustrated in FIG. 12. One side of the mechanical blind 1201 is coated with low emissivity materials. A second side of the mechanical blind 1202 is coated with high emissivity materials. The low and high emissivity sides can be easily switched between the emissive and reflective mode according to the weather.

DOCTRINE OF EQUIVALENTS

As can be inferred from the above discussion, the above-mentioned concepts can be implemented in a variety of arrangements in accordance with embodiments of the invention. Accordingly, although the present invention has been described in certain specific aspects, many additional modifications and variations would be apparent to those skilled in the art. It is therefore to be understood that the present invention may be practiced otherwise than specifically described. Thus, embodiments of the present invention should be considered in all respects as illustrative and not restrictive.

What is claimed is:

1. A device comprising:

an interior space;

an interior surface disposed within the interior space configured for absorption and reflection of a long-wave infrared heat from a long-wave infrared heat source and oriented to reflect the long-wave infrared heat;

wherein the interior surface comprises:

an at least one tunable emissivity material;

an at least one power source; and at least two electrodes;

wherein the at least one tunable emissivity material is disposed between the at least two electrodes;

wherein the at least one power source is electrically coupled to the at least one power source and the at least one tunable emissivity material and the at least one power source is configured to apply a voltage to the at least one emissivity material;

wherein the at least one tunable emissivity material is configured with at least a low emissivity state and a high emissivity state;

wherein the low emissivity state has an emissivity value smaller than about 0.5 over wavelength range from about 7 microns to about 14 microns and the high emissivity state has an emissivity value larger than about 0.8 over wavelength range from about 7 microns to about 14 microns for long-wave infrared wavelengths;

wherein the low emissivity state has low absorption and high reflection of long-wave infrared heat and the high emissivity state has high absorption and low reflection of long-wave infrared heat;

wherein tuning the at least one tunable emissivity material comprises applying the voltage to the at least one tunable emissivity material to change the emissivity state of the at least one tunable emissivity material to regulate radiative heat flow between the interior surface and a location; and wherein the interior surface is configured for a set point temperature such that when a target temperature exceeds the set point temperature the voltage is applied to at least one tunable emissivity material to change to an emissivity state with an emissivity value larger than about 0.8 to maintain thermal comfort at the location and when the target temperature falls below the set point temperature the voltage is applied to at least one tunable emissivity material to change to an emissivity state with an emissivity value smaller than about 0.5 to maintain thermal comfort at the location.

2. The device of claim 1, wherein the interior surface is a wall, a floor, or a ceiling.

3. The device of claim 1, wherein the at least one tunable emissivity material is a conducting polymer, an inorganic oxide, or a thermochromic material.

4. The device of claim 3, wherein the conducting polymer is poly(3,4-ethylenedioxythiophene), poly(3,4-ethylenedioxythiophene) tosylate, poly(3,4-ethylenedioxythiophene) polystyrene sulfonate, or polyaniline.

5. The device of claim 4, further comprising a solid electrolyte layer disposed between the conducting polymer and one of the at least two electrodes.

6. The device of claim 3, wherein the inorganic oxide is tungsten trioxide, hydrogen tungsten bronzes or vanadium dioxide.

7. The device of claim 3, wherein the inorganic oxide is ion-irradiated vanadium dioxide.

8. The device of claim 1, wherein the at least one tunable emissivity material comprises lithium titanate.

9. The device of claim 1, wherein tuning the surface to the low emissivity state decreases the set point temperature.

10. The device of claim 1, wherein tuning the surface to the high emissivity state increases the set point temperature.

11. The device of claim 1, wherein the at least one tunable emissivity material is transparent to visible wavelengths.

12. The device of claim 11, wherein the interior surface is a window.

13. The device of claim 1, wherein the heat source is at least one heat-generating object disposed within the interior space.

14. The device of claim 13, wherein the at least one heat-generating object comprises a human occupant.

15. The device of claim 13, wherein the location is disposed at the at least one heat-generating object.

* * * * *